US006669111B2

(12) United States Patent
Vinson et al.

(10) Patent No.: US 6,669,111 B2
(45) Date of Patent: Dec. 30, 2003

(54) PROTECTOR FOR THERMALLY RESPONSIVE MEMBER OF SPRINKLER HEAD

(75) Inventors: Chris A. Vinson, Erie, PA (US); Thomas E. Dorich, Erie, PA (US)

(73) Assignee: Polymer Molding, Inc., Erie, PA (US)

( * ) Notice: Subject to any disclaimer, the term of this patent is extended or adjusted under 35 U.S.C. 154(b) by 126 days.

(21) Appl. No.: 10/097,945

(22) Filed: Mar. 14, 2002

(65) Prior Publication Data

US 2003/0173094 A1 Sep. 18, 2003

(51) Int. Cl.[7] ..... B05B 15/04; A62C 37/08

(52) U.S. Cl. ..... 239/288; 239/288.3; 239/288.5; 169/37; 169/38; 169/41; 169/42; 169/56; 169/57; 169/58; 206/349

(58) Field of Search ..... 169/37, 38, 41, 169/42, 56, 57, 58; 239/288, 288.3, 288.5; 206/349, 461, 470, 795

(56) References Cited

U.S. PATENT DOCUMENTS

| | | | | | |
|---|---|---|---|---|---|
| 3,727,695 | A | * | 4/1973 | Danton | 169/37 |
| 3,797,746 | A | | 3/1974 | Gray et al. | 239/288.5 |
| 3,801,014 | A | | 4/1974 | Cantales | 239/104 |
| 3,904,033 | A | * | 9/1975 | Haerr | 206/349 |
| 4,366,866 | A | | 1/1983 | Sweeney | 169/37 |
| 4,706,759 | A | | 11/1987 | Grasseschi | 169/51 |
| 5,080,176 | A | * | 1/1992 | Polan et al. | 169/37 |
| 5,090,568 | A | * | 2/1992 | Tse | 206/470 |
| 5,152,344 | A | | 10/1992 | Fischer et al. | 169/37 |
| 5,632,339 | A | | 5/1997 | Fenske et al. | 169/37 |
| 6,131,822 | A | | 10/2000 | Farmer | 239/288 |
| 6,241,092 | B1 | * | 6/2001 | Vasudeva | 206/349 |
| 6,308,784 | B1 | * | 10/2001 | Mears | 169/37 |

FOREIGN PATENT DOCUMENTS

| | | | | |
|---|---|---|---|---|
| GB | 2187951 A | * | 9/1987 | A62C/37/14 |
| JP | 03292968 | | 4/1990 | |
| JP | 10071215 | | 3/1997 | |
| JP | 11235397 | | 2/1998 | |
| JP | 11267243 | | 3/1998 | |
| JP | 00014824 | | 6/1998 | |

* cited by examiner

*Primary Examiner*—Robin O. Evans
(74) *Attorney, Agent, or Firm*—Jon L. Woodard, Esq.; Edward W. Goebel, Jr.; MacDonald, Illig, Jones & Britton LLP

(57) ABSTRACT

A removable protector for protecting a thermally responsive member of a sprinkler head includes first and second shields each having protective surfaces. The protective surfaces are positioned to protect portions of the thermally responsive members that are exposed to potential contact with objects that are external to the sprinkler head. Each of the shields has a receiving end which slides over the sprinkler head during attachment of the protector. Each of the shields also has a connecting end attached to a cross member which connects the two shields and which provides an appropriate amount of spacing between the shields to permit clearance for accommodating various sprinkler head components when the protector is attached to the sprinkler head. A releasable fastener attaches the protector to the sprinkler head and secures the major protective surfaces of the first and second shields proximate the exposed portion of the thermally responsive member of the sprinkler head. This provides continuous protection of the thermally responsive member as long as the protector remains attached to the sprinkler head.

62 Claims, 20 Drawing Sheets

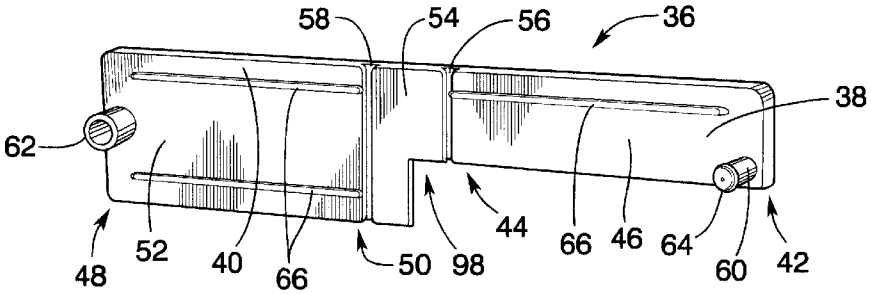
Fig.6A
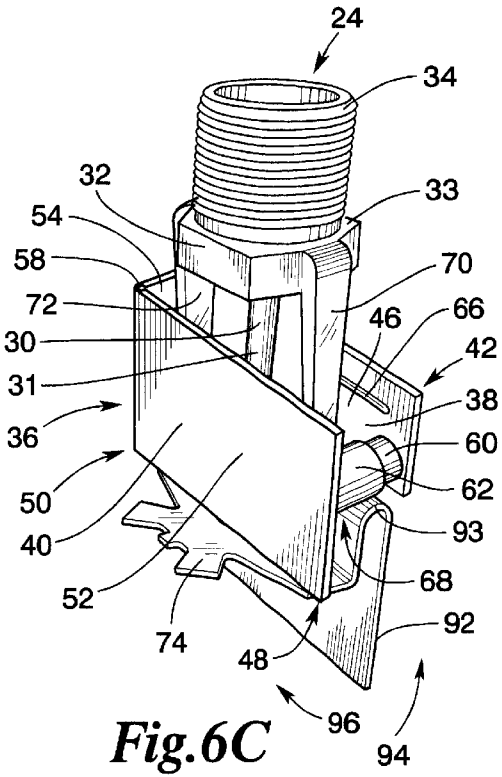
Fig.6C
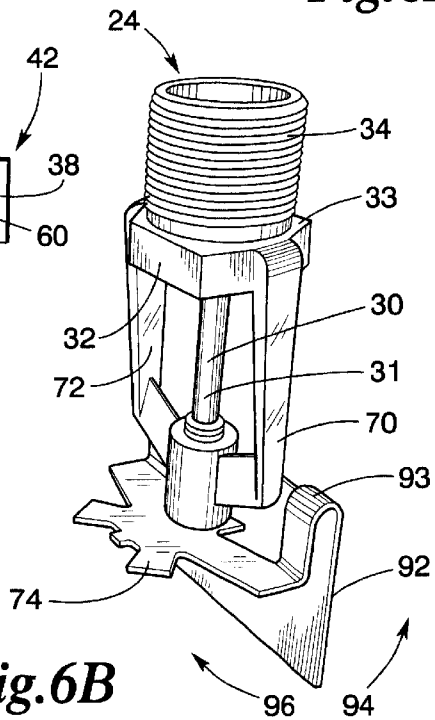
Fig.6B
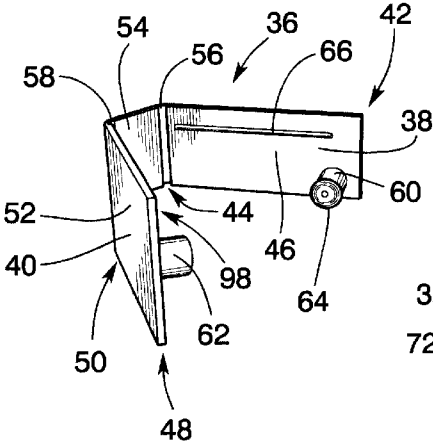

PROTECTOR FOR THERMALLY RESPONSIVE MEMBER OF SPRINKLER HEAD

BACKGROUND

This invention relates to protectors for protecting thermally responsive members of thermally operated sprinkler heads, and more particularly, to removable protectors for protecting thermally responsive members of sprinkler heads when a thermally responsive member is capable of making contact with an object external to the sprinkler head.

Thermally operated sprinklers are often installed in environments such as the walls or ceilings of commercial or residential buildings to reduce the possibility of fire, chemical reaction, or other high temperature or analogous condition. These types of sprinklers are normally fitted with at least one thermally responsive member such as a liquid tube or bimetallic strip which mechanically reacts to heat such as through breakage or thermal expansion to actuate other operating elements of the sprinkler during operation.

Most thermally responsive members are fragile and are subject to breakage during storage, transportation, mishandling, or installation. This is especially true when portions of a thermally responsive member are exposed to the environment and are likely to come into contact with objects that are external to the sprinkler head. The danger of dislodging or breaking a thermally responsive member can continue even after installation of a sprinkler head as additional items, such as wallboards, ceiling tiles/boards, escutcheon plates, lighting, or other fixtures or building materials, are installed in areas that are local to an installed sprinkler head. In most cases, damage or dislodging of the thermally responsive member requires the entire sprinkler head to be discarded and/or replaced, resulting in significant costs to the manufacturer, distributor, or installer.

A number of previous protectors have been designed to provide permanent, long-term protection for the thermally responsive members of mounted sprinkler heads. However, such designs have been limited in that they cannot be attached to a sprinkler head or provide protection for a thermally responsive member until after the sprinkler head has been installed. Generally, such designs do not permit an installation tool to engage the gripping surfaces of the sprinkler head while a protector is attached to the sprinkler head. Such previous designs have also been limited in that easy or single handed protector removal is either difficult or impossible.

Other previous protectors have been designed to protect thermally responsive elements prior to the installation of a sprinkler head. FIGS. 1A and 1B of the drawings depict a sprinkler 20 having a prior art protector 22. FIG. 1A is an exploded view of the sprinkler 20 which includes a sprinkler head 24, mounting plate 26, and escutcheon plate 28. The prior art protector 22 is cup-shaped to accommodate the sprinkler head 24. When the sprinkler 20 is assembled, the prior art protector 22 can be attached to the sprinkler head 24 by being inserted into the escutcheon plate 28, as shown in FIG. 1B. The outside surface of the prior art protector 22 is too large to fit within the inside diameter 84 of the escutcheon plate 28, requiring the installer to compress the outside surface 23 of the prior art protector 22 during installation. When inserted, the outside surface 23 of the prior art protector 22 locks against the inside diameter 84 of the escutcheon plate 28, allowing the prior art protector 22 to entirely conceal and thereby protect the sprinkler head 24 and its thermally responsive 30 member from damage.

There are multiple disadvantages to such existing protectors. As shown, the prior art protector 22 of FIGS. 1A and 1B requires the presence of an escutcheon plate 28 for the protector 22 to attach to the assembled sprinkler 20, making the design unsuitable for protecting the thermally responsive members of sprinklers having no similar escutcheon plate. Such protectors also require a relatively large amount of structural material to provide both concealment of the sprinkler head 24 and sufficient structural form to remain rigid while extending from an inserted position, such as from within the inside diameter 84 of the escutcheon plate 28.

In addition, such protectors are often incapable of providing continuous protection of a thermally responsive member up to and including the time of installation. For example, it is possible that the prior art protector 22, when inserted into the inside diameter 84 of the escutcheon plate 28, will slide out of the escutcheon plate 28 during transportation, handling, or storage, leaving the thermally responsive element 30 of the sprinkler head 24 unprotected. Since an escutcheon plate 28 must be mounted on the sprinkler 20 for the protector 22 to remain in place, the protector 22 cannot protect the sprinkler head 24 in circumstances where the escutcheon plate 28 must be omitted prior to the installation of other locally positioned building materials such as wall or ceiling boards. The entire sprinkler head 24 is concealed by such protectors, as best demonstrated in FIG. 1B. This makes it impossible for an installer to gain access to the sprinkler head 24 as required during installation without first removing the protector 22. For example, during installation of a sprinkler 20, it is normally necessary for the installer to rotate or "screw" the threads 34 of the sprinkler head 24 into the threads of a connecting pipe. To do so requires the installer to rotate the sprinkler head 24 by hand, or, as demonstrated in FIG. 4C, to use an installation tool to engage the gripping surfaces 32 at base 33 of the sprinkler head 24. Since the prior art protector 22 must be removed to permit access to any part of the sprinkler head 24, the resulting lack of a protector allows the thermally responsive element 30 to be broken during installation from accidental contact with the installer or with an installation tool.

SUMMARY

The invention is a removable protector for protecting a thermally responsive member of a sprinkler head from damage while the protector is attached to the sprinkler head. The protector includes first and second shields each having protective surfaces. The protective surfaces are positioned to protect portions of the thermally responsive member that are exposed to potential contact with objects that are external to the sprinkler head and which could potentially come into contact with the sprinkler head during storage, transportation, mishandling, or installation. Each of the shields has a receiving end which slides over the sprinkler head during attachment of the protector. Each of the shields also has a connecting end attached to a cross member which connects the two shields and which provides an appropriate amount of spacing between the shields to permit clearance for accommodating various sprinkler head components when the protector is attached to the sprinkler head.

A releasable fastener attaches the protector to the sprinkler head and secures the major protective surfaces of the first and second shields proximate the exposed portion of the thermally responsive member of the sprinkler head while the protector is attached to the sprinkler head. The fastener is easily released by the installer and enables the protector to provide continuous protection of the thermally responsive member from external objects as long as the protector remains attached to the sprinkler head.

In some embodiments of this invention, the cross member of the protector has a width that is significantly less than the width of the sprinkler head at the deflector and base of the sprinkler head. As a result, the first and second shields are spaced apart from each other by an attachment clearance that, when attached to the sprinkler head, prevents the protector from slipping off of the protector. The shields and cross member can be constructed to have a variety of shapes and configurations to accommodate numerous variations in the shapes of sprinkler heads, including shapes and/or configurations of thermally responsive members. The shields and cross members can also be connected using a number of different methods. For example, the protector can be constructed of a single molded piece having one or more living hinges that attach the shields and cross members. Alternatively, the protector can be flexibly constructed with a memory shape that permits it to be flexibly fastened to the sprinkler head and locked into position.

According to this invention, a releasable fastener may be any device which can attach the removable protector to the sprinkler head so as to secure the major protective surfaces of the first and second shields proximate the exposed portion of the thermally response member of the sprinkler head. The device used as a releasable fastener may vary with the type of sprinkler head to which it is to be attached and the manufacturing processes which are available and expedient. By way of example, a releasable fastener may include stanchions, hooks, bosses, positioning lugs, or other devices. One or more components of the releasable fastener, such as the male and female connectors of stanchion and hook fasteners, or the opposing lugs or bosses, may be mounted on the inside surfaces of the shields and/or be positioned at the connecting end or receiving end of each shield or include a tab attached to the receiving end of each shield. A number of embodiments include fasteners that allow the protector to be attached or detached from the sprinkler head with the use of one hand.

In some embodiments of the invention, the protector is dimensioned to permit the attachment of an installation tool, such as a wrench or socket, to the sprinkler head without requiring the removal of the protector. Thus, the invention can permit continuous protection of the thermally responsive element even during the installation of the sprinkler head, reducing the risk of damage from contact with an installation tool.

This invention does not reside in any one feature of the various embodiments of the protectors disclosed above which are more fully discussed in the Detailed Description and claimed below. Rather, this invention is distinguished from the prior art by a combination of structural features which make up a unique protector configuration. Important features of this invention are shown and described below to illustrate a number of the various contemplated alternatives for carrying out this invention.

Those skilled in the art will realize that this invention is capable of embodiments which are different from those shown in that the details of the structure of the disclosed protector embodiments can be changed in various manners without departing from the scope of this invention. Accordingly, the drawings and description are to be regarded as illustrative in nature and are not to restrict the scope of the invention. Additionally, the claims are to be regarded as including such equivalent protectors as do not depart from the nature and scope of this invention.

BRIEF DESCRIPTION OF THE DRAWINGS

For a more complete understanding and appreciation of this invention and its many advantages, reference will be made to the following detailed description of the invention taken in conjunction with the following drawings:

FIG. 6A depicts a protector having a side deflector panel accommodation notch according to one embodiment of this invention;

FIG. 6B depicts the protector of FIG. 6A prior to attachment to a sprinkler head having a side deflector;

FIG. 6C depicts the protector of FIG. 6A attached to a sprinkler head having a side deflector;

DETAILED DESCRIPTION

Figure 1B:
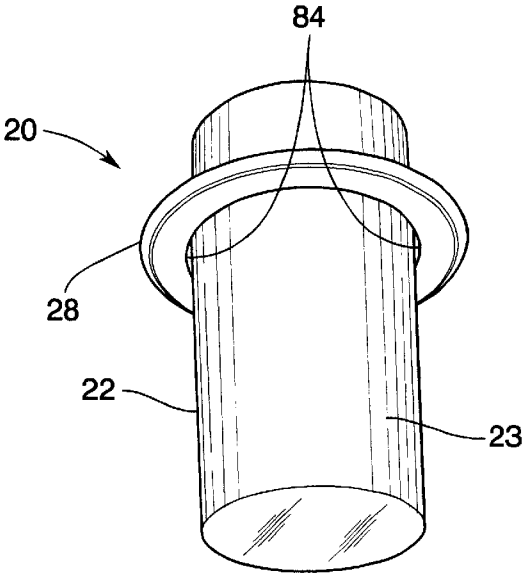
Prior Art Fig. 1B
FIG. 1B is an assembled view of the sprinkler of FIG. 1A.
Figure 1A:
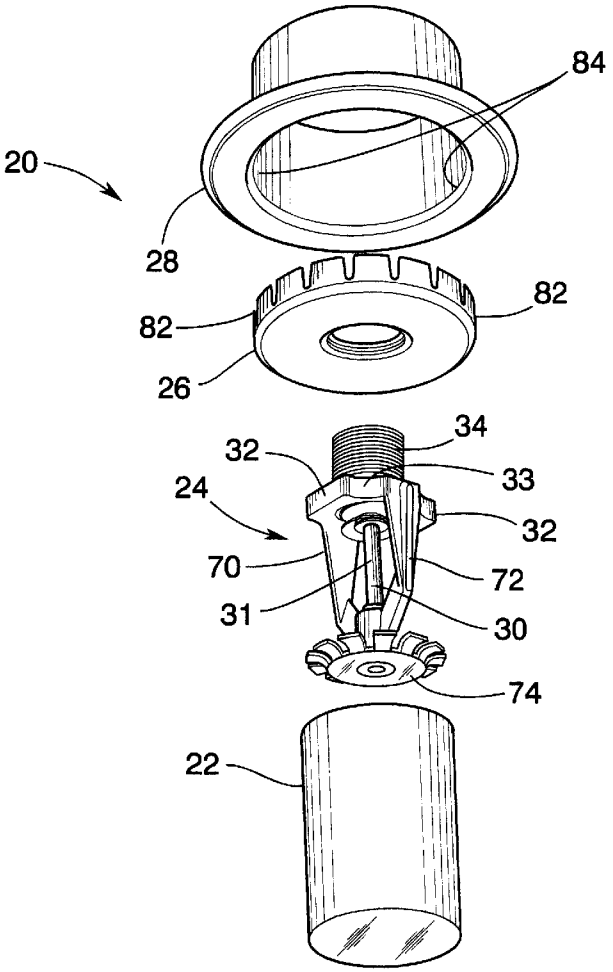
Prior Art Fig. 1A
FIG. 1A is an exploded view of a sprinkler having a prior art protector.

Referring again to the drawings, identical reference numerals and letters designate the same or corresponding parts throughout the several figures shown in the drawings. The invention is also depicted throughout the various drawings in the context of multiple variations in the construction and configurations of existing sprinkler heads.

Figure 2A:
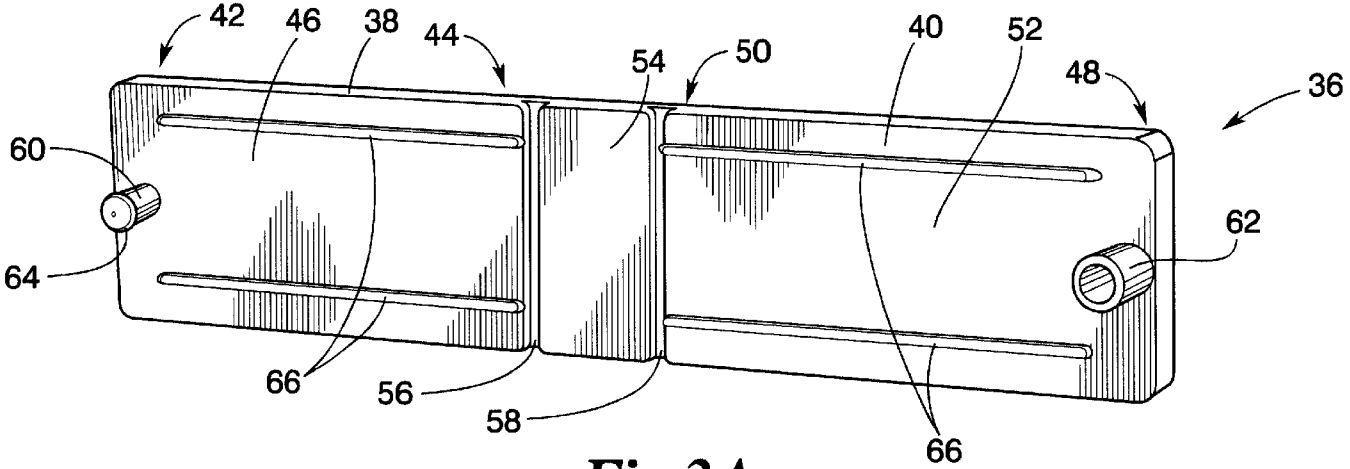
FIG. 2A depicts a protector according to one embodiment of this invention.

FIG. 2A depicts a protector 36 of this invention having a first shield 38 and a second shield 40. The first shield 38 has a receiving end 42 and a connecting end 44. A major protective surface 46 extends between the receiving end 42 and a connecting end 44 of the first shield 38. The second shield 40 has a receiving end 48 and a connecting end 50. A major protective surface 52 extends between the receiving end 48 and connecting end 50 of the second shield 40. A cross member 54 is connected to the connecting end 44 of the first shield 38 with a first living hinge 56. The cross member 54 is also connected to the connecting end 50 of the second shield 40 with a second living hinge 58.

As shown in FIG. 2A, the cross member 54, first shield 38, and second shield 40 can all be molded into a single elongated strip of a plastic polymer or similar structural material. The material of the protector 36 can be a bright, fluorescent or other type of highly visible or contrasting color that visually distinguishes the protector 36 from the sprinkler head 24 or surrounding components to be more easily noticed from a distance. The protector 36 can also be painted, dyed, or colored by a surface colorant to achieve the desired level of remote visibility. Additionally, the protector can be color coded to correspond to specific sprinkler types or operating characteristics of particular sprinklers.

Figure 2C:
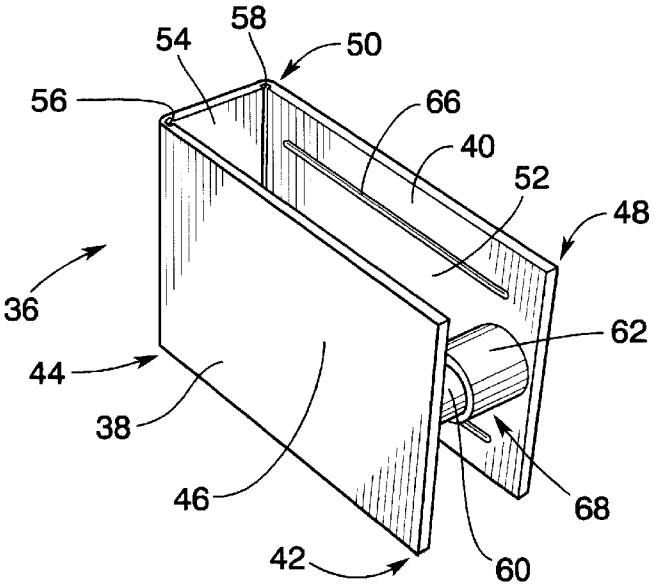
FIG. 2C depicts the protector of FIG. 2A with shields rotated to positions that provide protection for a thermally responsive member.
Figure 2B:
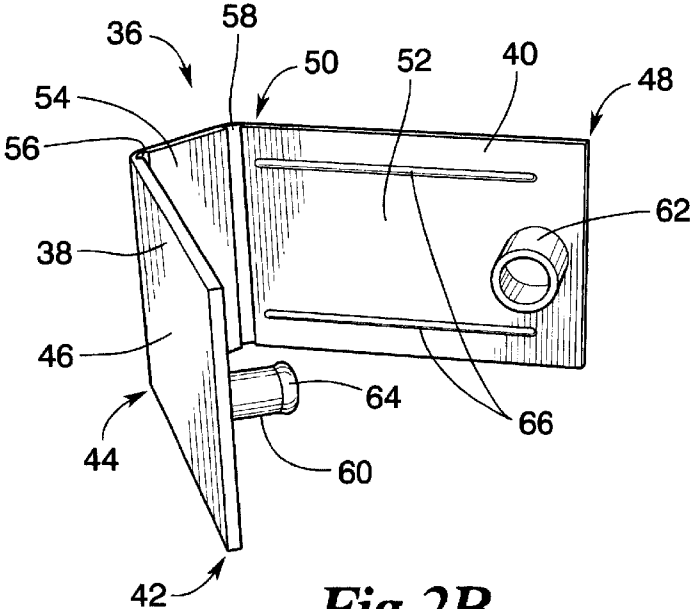
FIG. 2B depicts the protector of FIG. 2A with shields shown rotated according to an embodiment of this invention.

Living hinges 56 and 58 can then be formed by reducing the thickness of the elongated strip between the cross member 54 and first and second shields 38 and 40, allowing the strip to be bent so that the shields 38 and 40 rotate with respect to the cross member 54 about the living hinges 56 and 58 as shown in FIG. 2B. Stiffeners 66 can also be molded into the major protective surfaces 46 and 52 of the first and second shields 38 and 40 to prevent the protector 36 from bending at points other than at living hinges 56 and 58. The shields 38 and 40 can be rotated fully to a locked position shown in FIG. 2C. A male stanchion 60 extends from the receiving end 42 of the first shield 38 and a female stanchion 62 extends from the receiving end 48 of the second shield 40. As shown in FIG. 2C, the male stanchion 60 is positioned to engage the female stanchion 62 when the shields 38 and 40 are rotated fully to the locked position shown in FIG. 2C. As best seen in FIG. 2B, the male stanchion 60 includes a lip 64 which serves to lock the male stanchion 60 to the female stanchion 62. Together, the male stanchion 60 and female stanchion 62 form a releasable fastener 68 that is sufficient to secure the shields 38 and 40 in a locked position while the protector 36 is attached to a sprinkler head. The releasable fastener 68 can also be released easily with one hand by using a thumb and forefingers to pry the shields 38 and 40 apart so that the lip 64 of the male stanchion 60 slides out of engagement with the female stanchion 62.

Figure 3B:
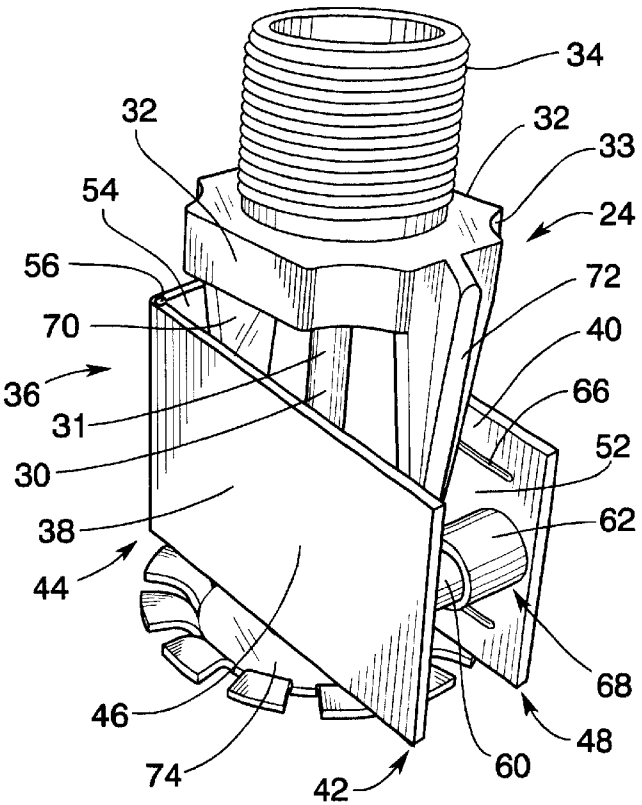
FIG. 3B depicts the protector of FIG. 2A attached to a sprinkler head.
Figure 3A:
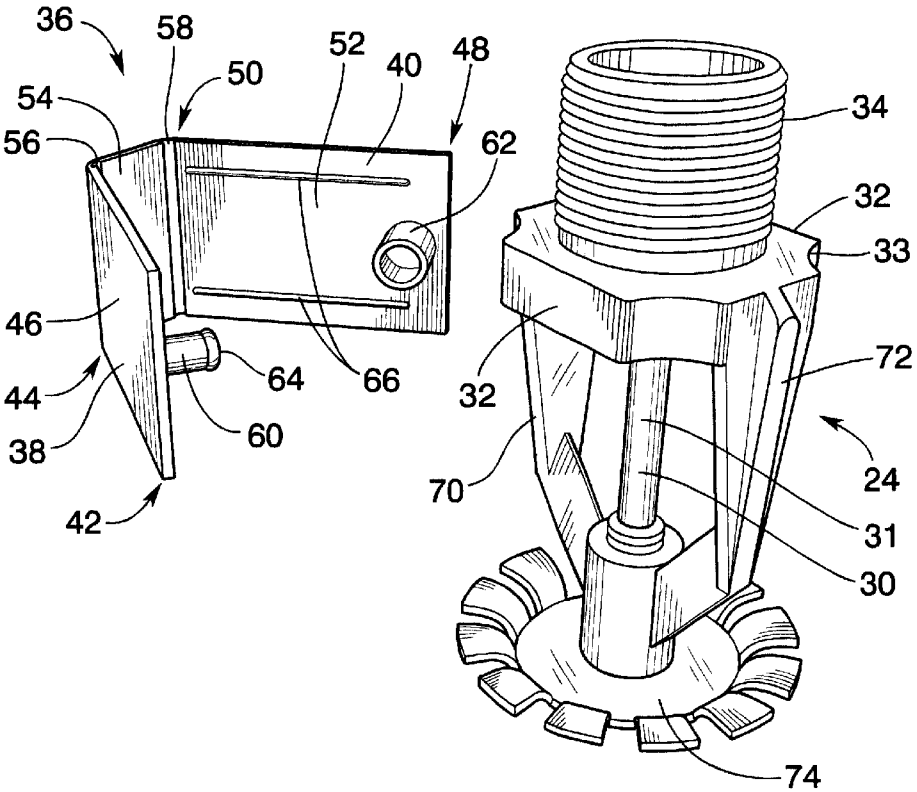
FIG. 3A depicts the protector of FIG. 2A immediately prior to attachment to a sprinkler head.

As shown in FIGS. 3A and 3B, attachment of the protector 36 to a sprinkler head 24 allows for continuous protection of a thermally responsive member 30 of the sprinkler head 24 until the protector 36 is removed. During attachment of the protector 36 to the sprinkler head 24, the first and second shields 38 and 40 are rotated apart to permit the male and female stanchions 60 and 62 of the releasable fastener 68 to fit around a first depending arm 70 of the sprinkler head 24, the thermally responsive element 30, and a second depending arm 72 of the sprinkler head 24, as shown in FIG. 3A. The shields 38 and 40 are then rotated toward each other so that the male and female stanchions 60 and 62 of the releasable fastener 68 engage to the locked position shown in FIG. 3B and thereby attach the protector 36 to the sprinkler head 24.

Once attached, the major protective surface 46 of the first shield 38 and the major protective surface 52 of the second shield 40 are each positioned adjacent the exposed portion 31 of the surface area of the thermally responsive member 30. Each major protective surface 46 and 52 of the protector 36 thereby serves to continuously shield the thermally responsive member 30 from damage while the protector 36 is attached to the sprinkler head 24.

Figure 4A:
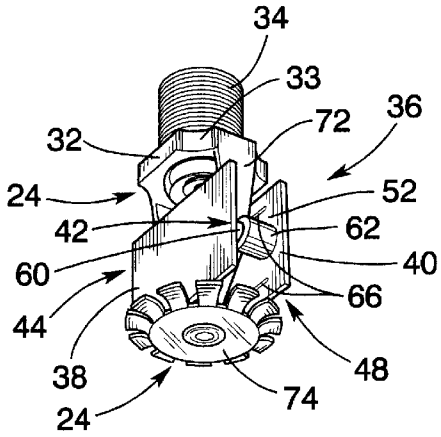
FIG. 4A depicts a sprinkler head with an attached protector.

Each shield 38 and 40 also serves to prevent the protector 36 from slipping off from attachment to the sprinkler head 24 by fitting within a deflector space separating the base 33 and the deflector 74 of the sprinkler head 24. As best understood by comparing FIGS. 3A and 3B, the first and second shields 38 and 40 of the protector 36, when in the locked position shown in FIG. 3B, are separated from each other by an attachment clearance that is approximately the spacing between first living hinge 56 and second living hinge 58 and the spacing established by the engaged male and female stanchions 60 and 62 of the releasable fastener 68. As best shown in FIGS. 3B and 4A, this attachment clearance is less than the width of base 33 and deflector 74. Due to the relative sizing of the first and second shields 38 and 40, each shield 38 and 40 also remains locked within the deflector space between the base 33 and deflector 74 when the protector 36 is attached to the sprinkler head 24 as shown in FIGS. 3B and 4A. This prevents the protector 36 from slipping off the sprinkler head 24. Since the releasable fastener 68 secures the first and second shields 38 and 40 together by a distance that is roughly the same as the attachment clearance of the cross member 54, this spacing between the shields enables the releasable fastener 68 to also lock the protector 36 in position on the sprinkler head 24.

Figure 4B:
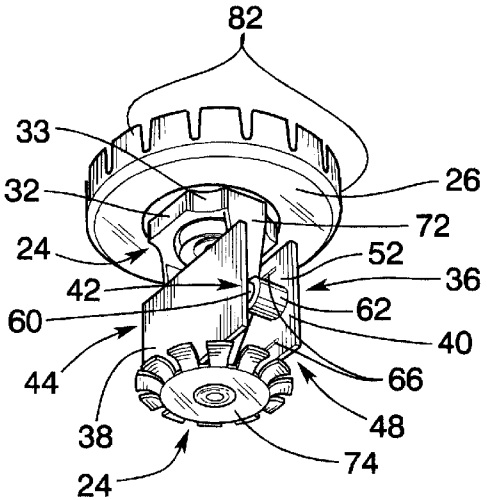
FIG. 4B depicts the sprinkler head with attached protector of FIG. 4A, the sprinkler head being attached to a mounting plate.
Figure 4C:
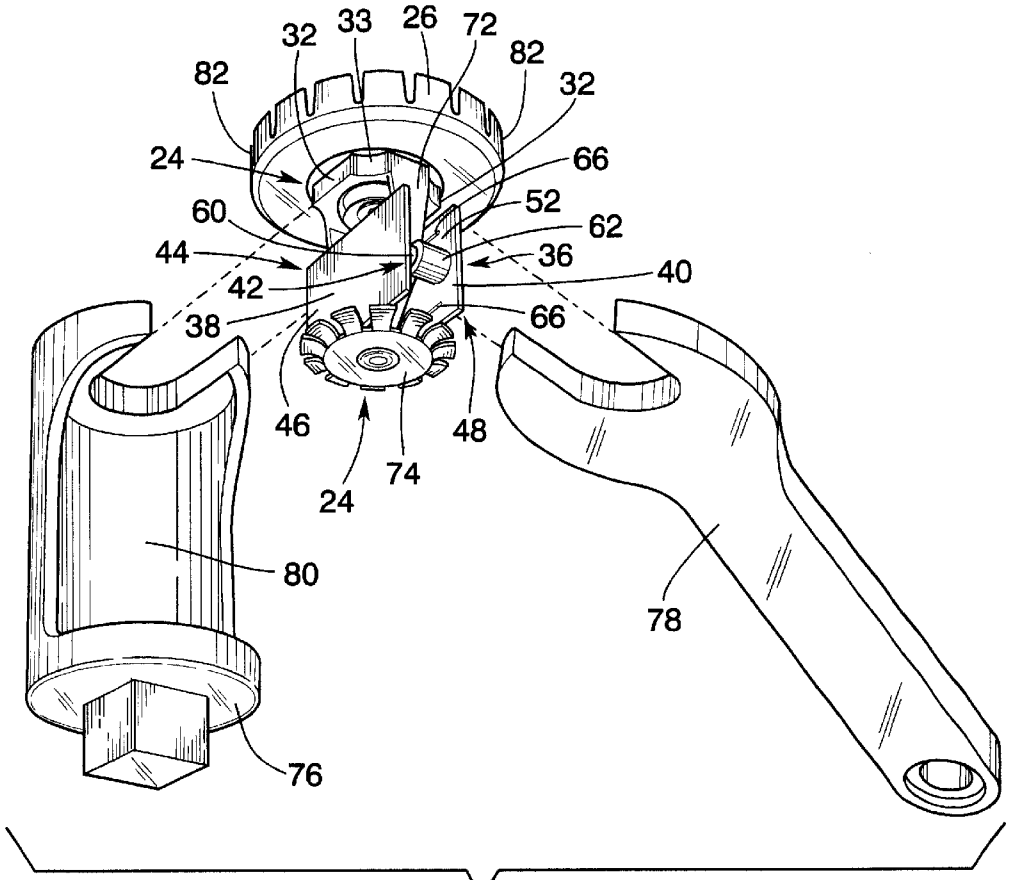
FIG. 4C illustrates the manner in which different installation tools can engage the gripping surfaces of the sprinkler head of FIG. 4B while a protector remains attached.

Referring now to FIG. 4A, the sprinkler head 24 is depicted having an attached protector 36. Depending on the application or environment in which the sprinkler head 24 is mounted, it may be necessary to use an installation tool such as a wrench or socket to provide sufficient torque to rotate the sprinkler head 24 about the sprinkler head threads 34 to a desired tightness. It may also be necessary or desirable to add a mounting plate 26 to the sprinkler head threads 34 prior to installation of the sprinkler head 24 as shown in FIG. 4B. However, removal of the protector 36 prior to the use of an installation tool would leave the exposed portions 31 of the thermally responsive member 30 subject to possible contact or breakage during installation. For this reason, it is advantageous for the protector 36 to be configured to permit engagement with an installation tool at gripping surfaces 32 of the base 33, even when the mounting plate 26 is attached. As best seen in the views of the protector 36 when attached to the sprinkler head 24 in FIGS. 4A and 4B, the attachment clearance between the first shield 38 and second shield 40, is considerably less than the width of the base 33 of the sprinkler head 24, while the heights of each of the first and second shields 38 and 40 permit each shield to be locked within the deflector space between the base 33 and deflector 74. As shown in FIG. 4C, this permits the gripping surfaces 32 of the base 33 to remain accessible for engagement by an installation tool such as a socket 76 or wrench 78.

Figure 4E:
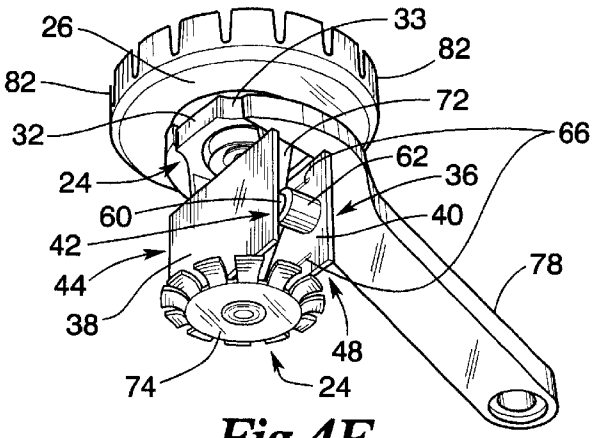
FIG. 4E depicts the sprinkler head with protector and mounting plate of FIG. 4B with a wrench engaging the sprinkler head.
Figure 4G:
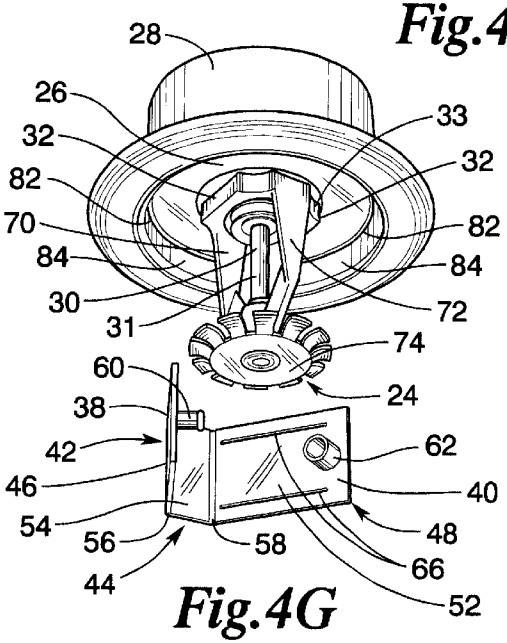
FIG. 4G depicts removal of the protector from the sprinkler head after installation of the escutcheon plate.
Figure 4D:
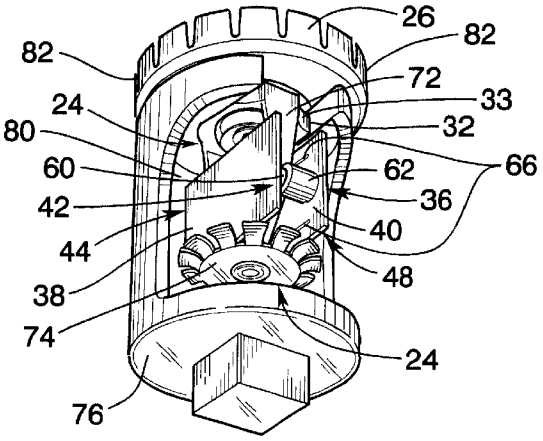
FIG. 4D depicts the sprinkler head with protector and mounting plate of FIG. 4B with a socket engaging the sprinkler head.

FIG. 4D depicts how the attachment clearance between the first shield 38 and second shield 40 permits a socket 76 to be attached to a sprinkler head 24 while the sprinkler head 24 is mounted on a mounting plate 26 and while a protector 36 remains attached to the sprinkler head 24. As depicted in FIG. 4D, each shield 38 and 40 of the attached protector 36 is locked between the base 33 and deflector 74 of the sprinkler head 24, positioning the protector 36 on the sprinkler head 24 as shown. As the socket 76 engages the gripping surfaces 32 of the base 33, the protector 36, along with the thermally responsive member 30, deflector 74, and first and second depending arms 70 of the sprinkler head 24 all fit within interior space 80 of the socket 76, allowing the socket 76 to engage the gripping surfaces 32 without interference from the protector 36. Thus, the socket 76 can be used to rotate and tighten or loosen the sprinkler head 24 about its threads 34 without requiring the removal of the protector 36.

FIG. 4E similarly depicts how the protector 36 permits a wrench 78 to engage the gripping surfaces 32 for tightening or loosening of the sprinkler head 24. As shown in FIG. 4E, the attachment clearance between the first shield 38 and second shield 40 prevents the protector 36 from obstructing engagement of the gripping surfaces 32 by the wrench 78 due to the larger width of the base 33. The wrench 78 can then be used to rotate the sprinkler head 24 without removal of the protector 36.

Figure 4F:
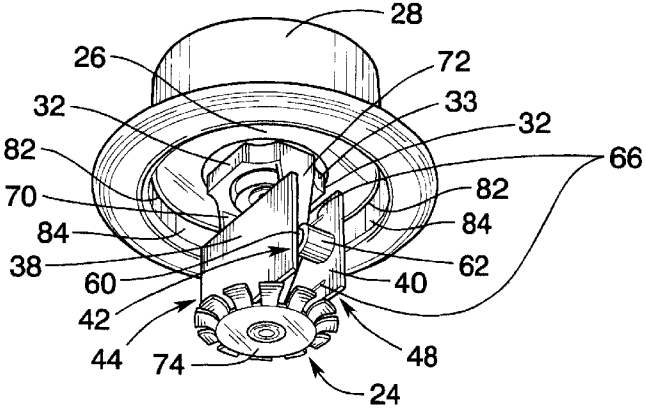
FIG. 4F depicts the sprinkler head with protector and mounting plate of FIG. 4B after the installation of an escutcheon plate.

The protector 36 can also remain attached to the sprinkler head 24 as additional components or construction materials are added to the sprinkler or to areas that are adjacent the location of the sprinkler's installation. For example, FIG. 4F depicts a sprinkler head 24 mounted to a mounting plate 26 and having a protector 36 attached, an escutcheon plate 28 being fitted to the outside diameter 82 of the sprinkler head 24. The escutcheon plate 28 has an inside diameter 84 that engages the outside diameter 82 of the mounting plate 26 when the escutcheon plate 28 is moved into a mounted position as shown in FIG. 4F. As depicted, the protector 36 has a length extending from the connecting ends 44 and 50 to the receiving ends 42 and 48 of the first shield 38 and second shield 40 that is less than the inside diameter 84 of the escutcheon plate 28. Thus, the protector 36 can pass within the inside diameter 84 of the escutcheon plate 28 and can remain attached to the sprinkler head 24 to protect the thermally responsive member 30 from damage as the escutcheon plate 28 engages the outside diameter 82 of the mounting plate 26.

Referring to FIG. 4G, the length of the protector 36 also permits removal from the sprinkler head 24 after installation of the escutcheon plate 28. FIG. 4G depicts the protector 36 being removed from the sprinkler head 24 by disengaging the male stanchion 60 from the female stanchion 62. An installer can easily disengage the male stanchion 60 from the female stanchion 62 with one hand by using fingers to pry the first shield 38 from the second shield 40. The first shield 38 and second shield 40 can then be rotated away from each other about first and second living hinges 56 and 58, as shown in FIG. 4G, so that the protector 36 disengages from its locked position on the sprinkler head 24. The relative positioning and length of the protector 36 allow the protector 36 to be removed without interference from the inside diameter 84 of the escutcheon plate 28.

Figure 5:
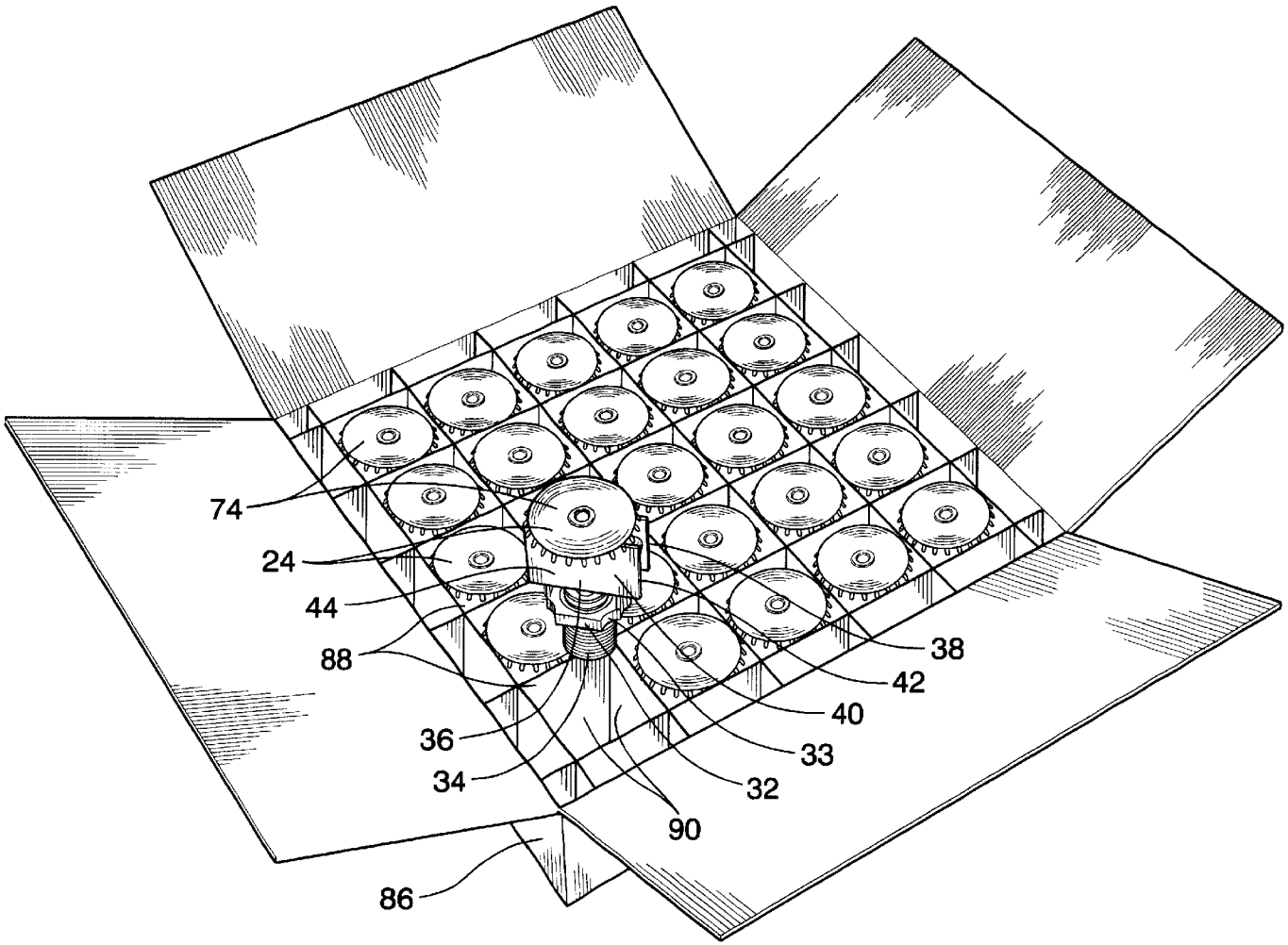
FIG. 5 depicts storage in a multiple unit carton of sprinkler heads having attached protectors.

The length of the protector 36 also allows for protection of the thermally responsive member 30 of the sprinkler head 24 during transportation or storage. For example, FIG. 5 depicts a storage box 86 of the type typically used for shipping and storing multiple sprinkler heads 24 prior to installation. The storage box 86 includes a matrix of square shaped storage cells 88, each storage cell 88 having four interior walls 90 that are configured to securely store a single sprinkler head 24 in an upright position as shown. FIG. 5 includes a view of one sprinkler head 24 having an attached protector 36 immediately prior to insertion into an unoccupied storage cell 88. It will be noted from the figure that the sprinkler head 24 has been rotated so that the first shield 38 and second shield 40 of the protector 36 are oriented at a diagonal angle with respect to the interior walls 90 of the unoccupied storage cell 88. The lengths of the first shield 38 and second shield 40 give the protector 36 an overall length that enables the protector 36 to remain attached to the sprinkler head 24 as the sprinkler head 24 is inserted into the storage cell 88, allowing the protector 36 to continuously protect the thermally responsive member 30 of the sprinkler head 24 during transportation and storage.

It will be appreciated that the protector of this invention can also be configured to protect thermally responsive members of sprinkler heads having varying shapes and configurations of deflectors and other components. FIG. 6A depicts a protector 36 in which the first shield 38 and second shield 40 each have different preselected heights. Referring briefly to FIG. 6B, a sprinkler head 24 is depicted that has a deflector 74 including a side deflector 92 having an inward curved portion 93 which extends from the deflector 92 toward the base 33 of the sprinkler head 24 and which is separated from the sprinkler head 24 by a first deflector space. The first depending arm 70 and second depending arm 72 define a bisecting plane having a first bisecting plane side 94 and a second bisecting plane side 96. The side deflector 92 is positioned in the first bisecting plane side 94 of the bisecting plane. The deflector 74 is separated from the base 33 in the second bisecting plane side 96 by a second deflector space.

Referring again to FIG. 6A, the first shield 38 has a preselected height that is less than that of the second shield 40. The preselected height of the first shield 38 allows the major protective surface 46 of the first shield 38 to extend between the base 33 of the sprinkler head 24 and the inward curved portion 93 of the side deflector 92 in the first bisecting plane side 94. The preselected height of the second shield 40 allows the major protective surface 52 of the second shield 40 to extend between the base 33 of the sprinkler head 24 and the deflector 74 in the second bisecting plane 96. The cross member 54 has a side deflector accommodation notch 98 to accommodate the inward curved portion 93 of the side deflector 92 when the protector 36 is attached to the sprinkler head 24.

FIG. 6C depicts the protector 36 of FIG. 6A attached to a sprinkler head 24 of FIG. 6B. As best understood with reference to FIG. 6C, when the protector 36 is attached to the sprinkler head 24, the attachment clearance between the first shield 38 and second shield 40 is less than the widths of the base 33 and deflector 74. As a result, the protector 36 remains locked by the releasable fastener 68 in position on the sprinkler head 24 as shown.

In some existing sprinkler heads, a deflector may be rotated so that the side deflector is not entirely positioned within one bisecting plane side. Referring briefly to FIG. 7B, the depicted deflector 74 of the sprinkler head 24 is rotated 90 degrees relative to deflector 74 of the sprinkler head 24 depicted in FIGS. 6B and 6C. Thus, in FIG. 7B, the deflector 74 and side deflector 92 extend into both the first bisecting plane side 94 and second bisecting plane side 96 as defined by the first and second depending arms 70 and 72.

Figure 7A:
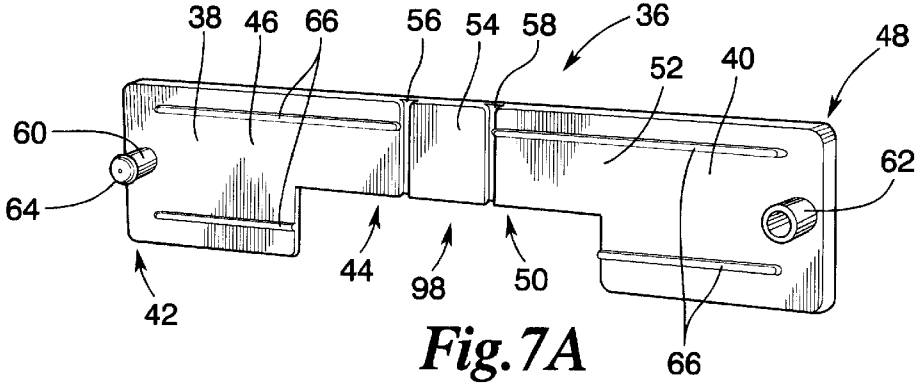
FIG. 7A depicts a protector having a side deflector panel accommodation notch according to one embodiment of this invention.
Figure 7C:
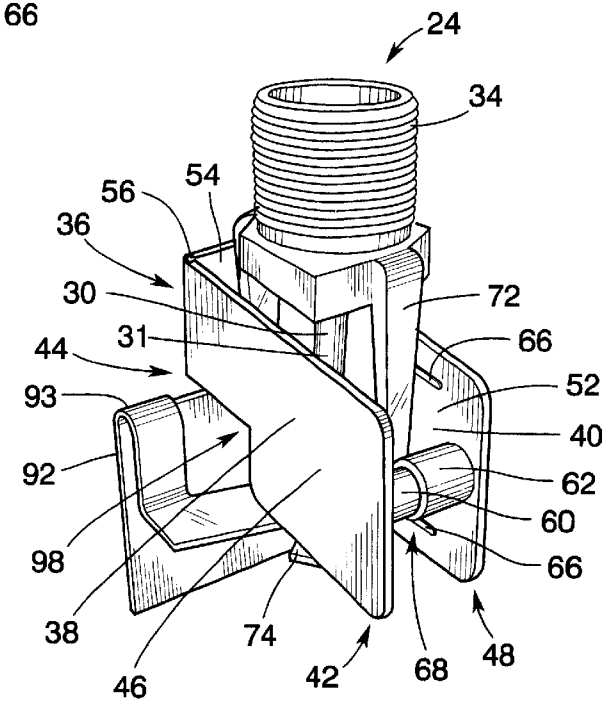
FIG. 7C depicts the protector of FIG. 7A attached to a sprinkler head having a side deflector.
Figure 7B:
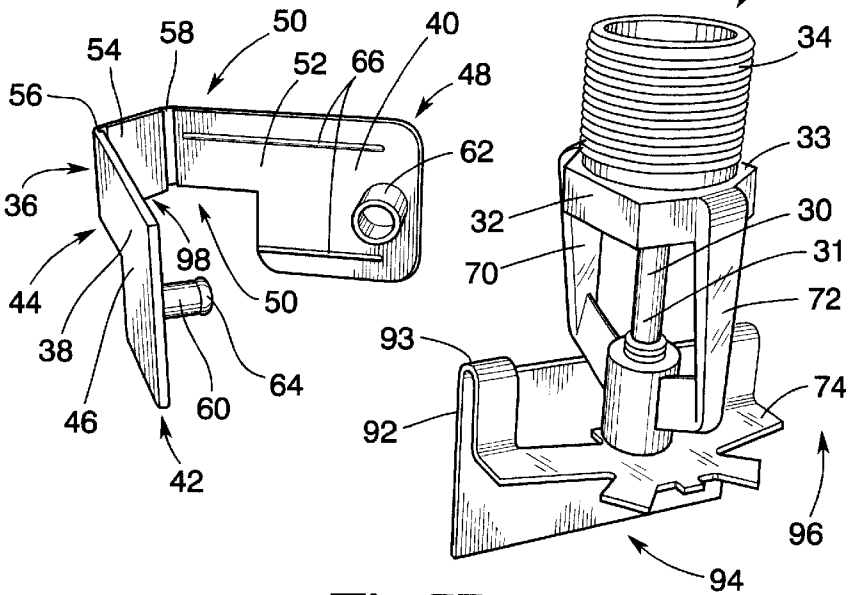
FIG. 7B depicts the protector of FIG. 7A prior to attachment to a sprinkler head having a side deflector.

Referring now to FIG. 7A, a protector 36 is depicted in which the side deflector accommodation notch 98 extends from the first shield 38 across the cross member 54 to the second shield 40. As shown in FIGS. 7A–7C, the heights of the first shield 38 and second shield 40 are approximately the same. During attachment of the protector 36 to the sprinkler head 24, the accommodation notch 98 provides clearance to allow the protector 36 to attach securely to the sprinkler head 24 between base 33 and deflector 74 without interference from the inward curved portion 93 of the side deflector 92. The width of the base 33 and deflector 74 remain wider than the attachment clearance between the first shield 38 and second shield 40, securing the protector 36 in position on the sprinkler head 24. Protectors modified to allow for attachment to sprinkler heads having additional components and/or configurations are also possible and are fully contemplated to be within the scope of the invention.

Figure 11A:
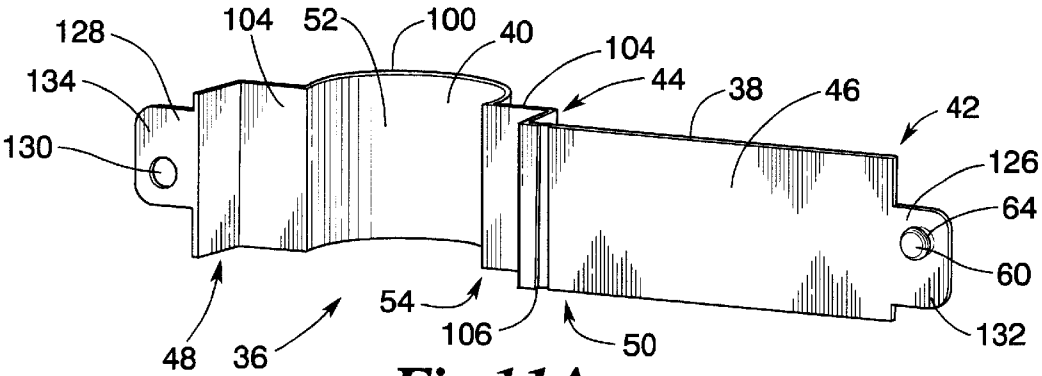
FIG. 11A depicts a protector according to one embodiment of this invention.
Figure 11B:
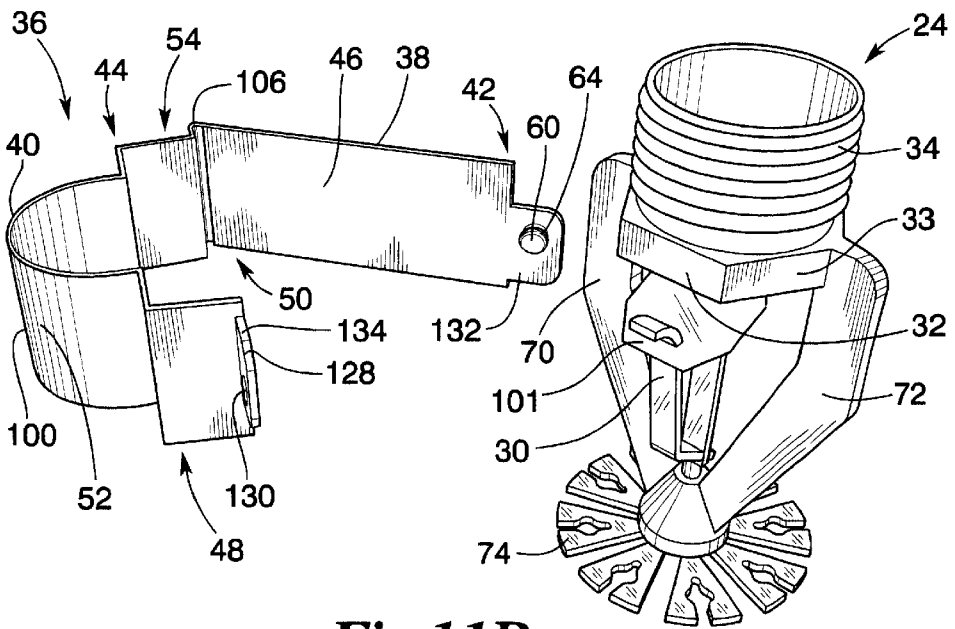
FIG. 11B depicts the protector of FIG. 11A prior to attachment to a sprinkler head.
Figure 11C:
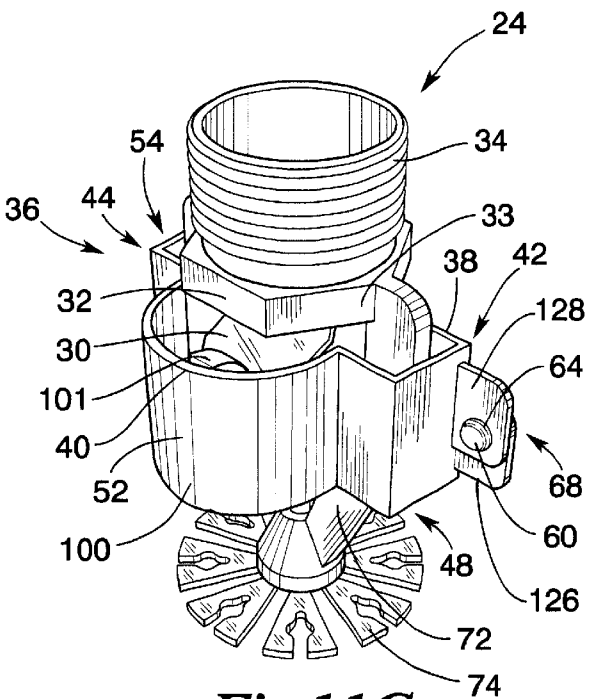
FIG. 11C depicts the protector of FIG. 11A attached to a sprinkler head.

For example, FIG. 11A depicts a protector 36 having an expanded radius 100 for accommodating outwardly extending thermally responsive members such as the thermally responsive member 30 having a protruding portion 101 depicted on the sprinkler head 24 as shown in FIG. 11B, the protruding portion 101 extending beyond the attachment clearance between the first shield 38 and inner portions 104 of the second shield 40, the attachment clearance being the approximate width of the cross member 54.

Figure 12A:
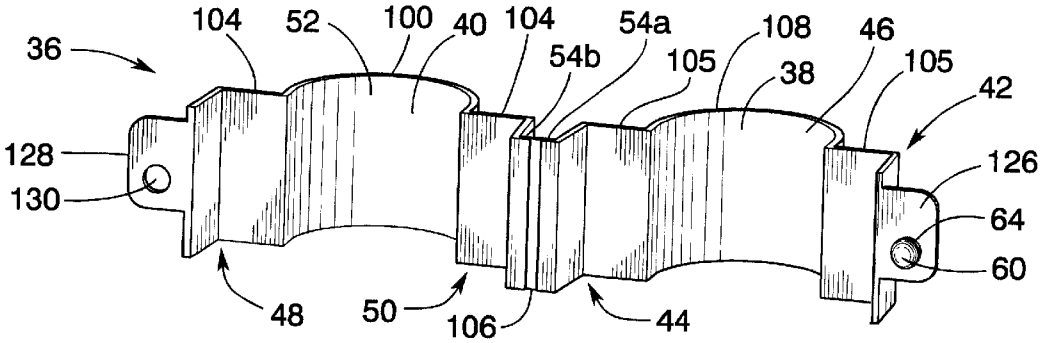
FIG. 12A depicts a protector according to one embodiment of this invention.
Figure 12C:
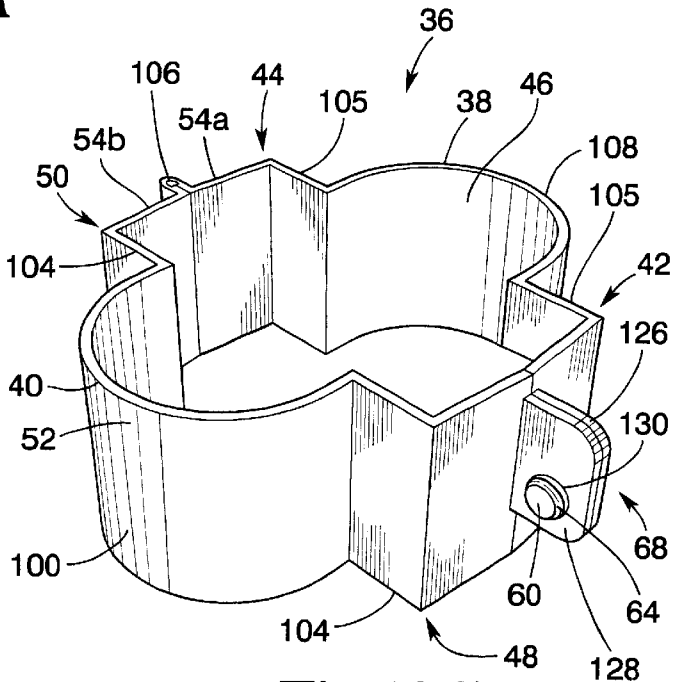
FIG. 12C depicts the protector of FIG. 12A with shields shown rotated as when attached to a sprinkler head.
Figure 12B:
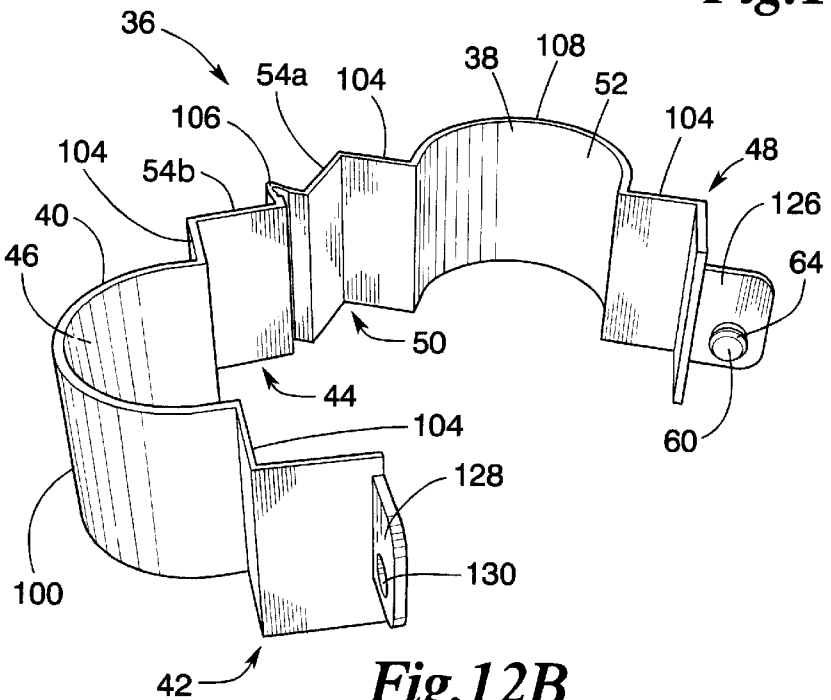
FIG. 12B depicts the protector of FIG. 12A with shields shown rotated prior to attachment to a sprinkler head.

It will be noted that the cross member 54 is, in this embodiment of the invention, molded into the second shield 40 and is without a first living hinge as depicted in the embodiment of FIGS. 2A–C. A single living hinge 106 connects the cross member 54 to the connecting end 50 of the first shield 38. In comparison, FIGS. 12A–B depict an embodiment of the invention in which the cross member is divided into a first portion 54*a* and a second portion 54*b* by a single living hinge 106, each of the first and second portions 54*a* and 54*b* of the cross member providing a portion of the total approximate attachment clearance between the first and second shields 38 and 40 when the protector 36 is attached to a sprinkler, as best understood with reference to FIG. 12C. It will be appreciated that such variations in molded connections between cross members and shields and variations in the number or configurations of hinges are contemplated and intended to be fully within the scope of this invention.

Also contemplated to be within the scope of this invention are variations in the construction, orientation, and configuration of shields. As one illustrative example, FIG. 12A depicts an embodiment of the invention having a second expanded radius 108 extending outward from inner portions 105 of the first shield 38 for accommodating a thermally responsive member where the thermally responsive member includes a second outwardly extending component, as may be present in certain sprinkler head designs.

Figure 10A:
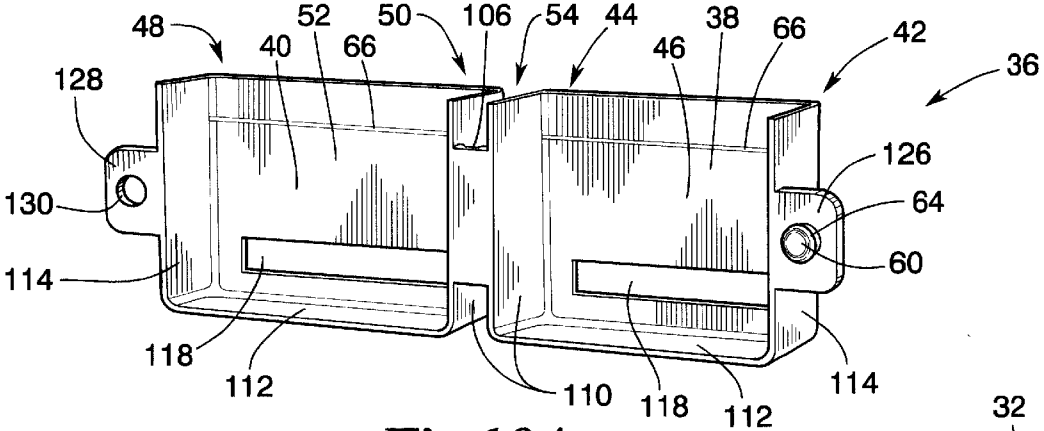
FIG. 10A depicts a protector according to one embodiment of this invention.
Figure 10C:
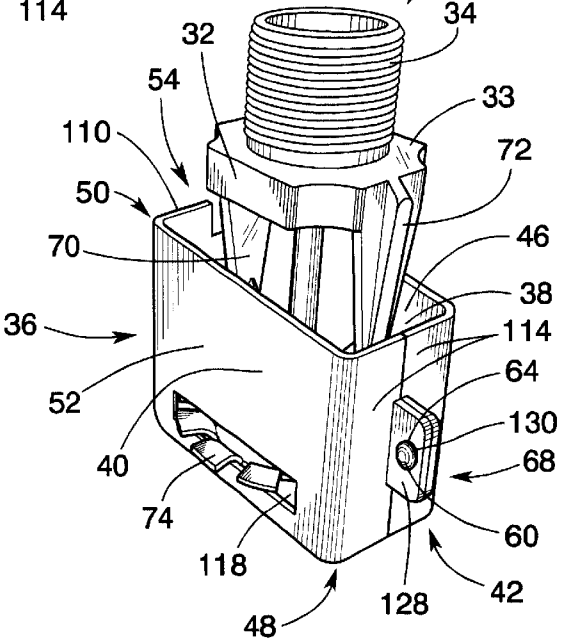
FIG. 10C depicts the protector of FIG. 10A attached to a sprinkler head.
Figure 10B:
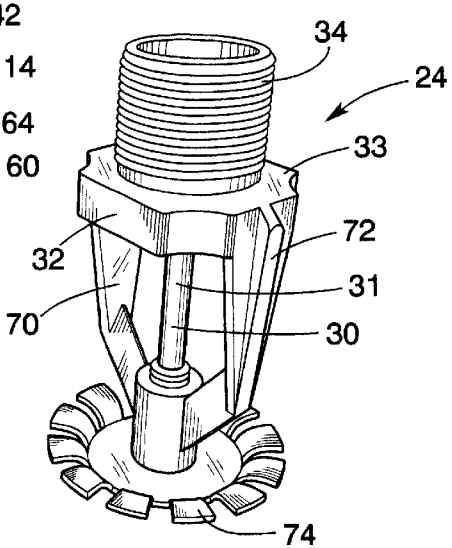
FIG. 10B depicts the protector of FIG. 10A prior to attachment to a sprinkler head.
Figure 10B:
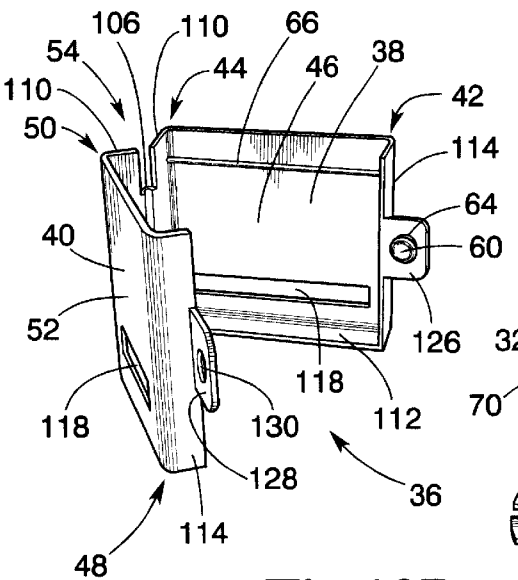

Another illustrative example of a possible variation in the construction, orientation, and configuration of the shields is depicted in FIG. 10A. In the depicted embodiment of the protector 36, each connecting end 44 and 50 of the first and second shields 38 and 40 includes a first enclosure 110 extending inward toward a single living hinge 106. As best understood with reference to FIGS. 10B and 10C, each first enclosure 110 is positioned inward to form part of the cross member 54 between the first shield 38 and second shield 40, the combined widths of the first enclosures 110 forming the attachment clearance between the shields as the shields are rotated about living hinge 106 (as shown in FIG. 10B) to attach the protector 36 to the sprinkler head 24 (as shown in FIG. 10C). Second enclosures 112 extend inward between the connecting end 44 and receiving end 42 of the first shield 38 and between the connecting end 50 and receiving end 48 of the second shield 40. Third enclosures 114 extend inward from the receiving end 42 of the first shield 38 and from the receiving end 48 of the second shield 40. As best understood with reference to FIGS. 10B and 10C, as the first shield 38 and second shield 40 of the protector 36 are rotated about the living hinge 106 to attach the protector 36 to sprinkler head 24, the first enclosure 110, second enclosure 112, and third enclosure 114 of the first shield 38 and second shield 40 provide a more complete and enclosing level of protection for the exposed portion 31 of the thermally responsive member 30.

In this embodiment, the enclosures 110, 112, and 114 also serve to partially enclose the deflector 74 of the sprinkler head 24. As best shown in FIG. 10C, the attachment clearance between the first shield 38 and second shield 40 is less than the width of the deflector 74. For this reason, the major protective surfaces 46 and 52 of the first and second shields 38 and 40 each have a deflector accommodation notch 118 to provide clearance for the excess width of the deflector 74 when the protector 36 is attached to the sprinkler head 24. When the protector 36 is attached to the sprinkler head 24 and secured with releasable fastener 68, the deflector accommodation notches 118 also prevent the protector 36 from sliding along the height of the sprinkler head 24, thereby locking the protector 36 in position.

Figure 16A:
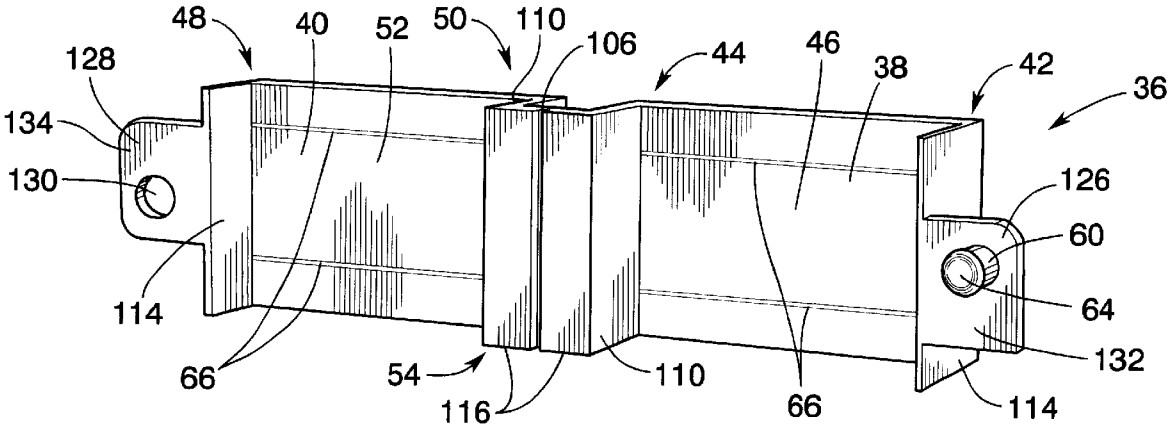
FIG. 16A depicts a protector according to one embodiment of this invention.
Figure 16C:
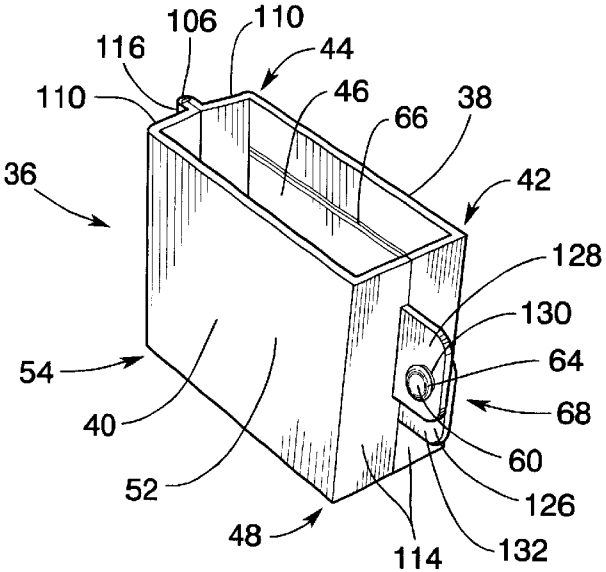
FIG. 16C depicts the protector of FIG. 16A with shields shown rotated as when attached to a sprinkler head.
Figure 16B:
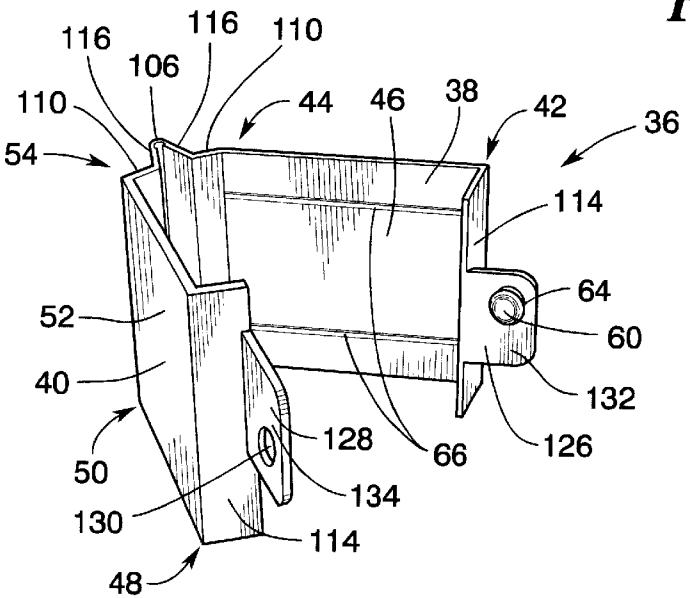
FIG. 16B depicts the protector of FIG. 16A with shields shown rotated prior to attachment to a sprinkler head.

A slightly modified form of this embodiment of the protector 36, as depicted in FIG. 16A, eliminates the need for a reflector accommodation notch or second enclosure. In this embodiment, the cross member 54 of the protector 36 is divided by a single living hinge 106 into member portions 116 extending from each first enclosure 110. Second enclosures and deflector accommodation notches are omitted in this modified embodiment. As best understood with reference to FIGS. 16B and 16C, first shield 38 and second shield 40 can be rotated about the living hinge 106 and secured to an attached position on a sprinkler head with releasable fastener 68, as shown in FIG. 16C. As with the previously described embodiment of the protector depicted in FIGS. 3A and 3B, the height and attachment clearance of the protector 36 of FIGS. 16A–C enable the protector 36 to lock between the base and deflector of a sprinkler head.

Although the protector of this invention has been shown and described in terms of certain embodiments having one or more living hinges allowing for the rotation of shields with respect to a common cross member, it will be appreciated that other embodiments of this invention can be constructed without the use of a living hinge. For example, FIG. 8A is a top view of one protector 36 according to this invention formed from a single flexible component where the connecting end 44 of the first shield 38 and the connecting end 50 of the second shield 40 are flexibly molded to cross member 54. The single flexible component of the protector 36 may be constructed of a resilient material such as plastic which has a memory shape that enables the protector 36 to be pliable and retain its general shape after the first shield 38 and second shield 40 are momentarily flexed apart during installation or removal on or from a sprinkler head 24. A releasable fastener 68 includes two bosses 120 positioned opposite each other on the inward sides of the first and second major protective surfaces 46 and 52 of the first and second shields 38 and 40. The memory shape of the single molded component of the protector 36 establishes an attachment clearance between the first shield 38 and second shield 40.

Figure 8B:
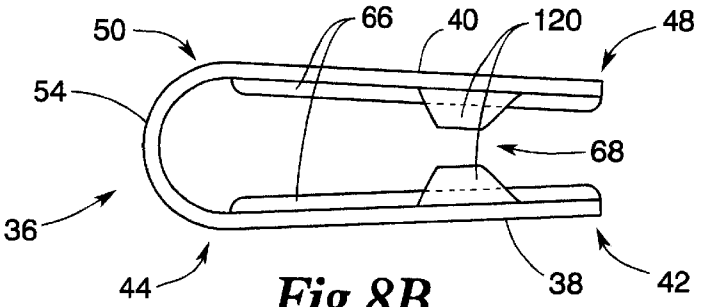
FIG. 8B depicts a protector according to one embodiment of this invention.
Figure 8A:
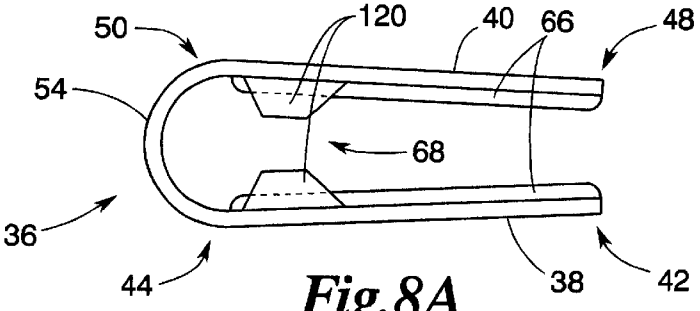
FIG. 8A depicts a protector according to one embodiment of this invention.
Figure 8D:
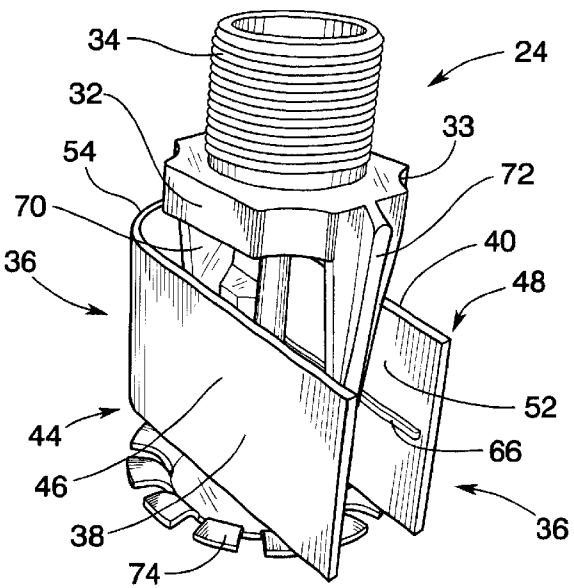
FIG. 8D depicts the protector of FIG. 8A attached to a sprinkler head.
Figure 8C:
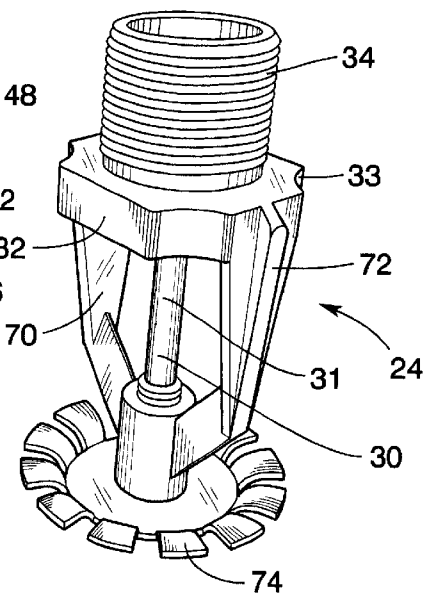
FIG. 8C depicts the protector of FIG. 8A prior to attachment to a sprinkler head.
Figure 8C:
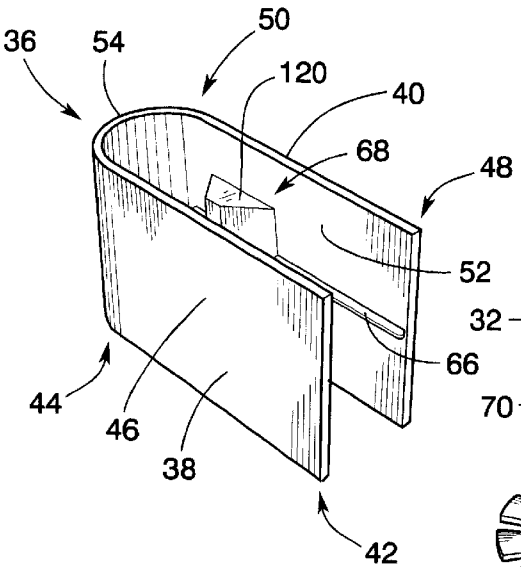

Referring now to FIG. 8C, the bosses 120 are positioned to move apart from each other as the installer flexibly pries the first shield 38 away from the second shield 40 during installation. This prying action by the installer allows for sufficient clearance to exist between the bosses 120 to permit the first and second shields 38 and 40 of the protector 36 to slide over the first depending arm 70 to the position depicted in FIG. 8D. Once protector 36 is moved to the position on the sprinkler head 34 that is shown, the installer can then release the shields 38 and 40 so that the single component of the protector 36 flexibly returns to its memory shape. This action restores the attachment clearance between the first and second shields 38 and 40 so that the bosses 120 lock between the first depending arm 70 and the thermally responsive member 30. Like the embodiment depicted in FIGS. 3A and 3B, the height of the protector 36 and attachment clearance between the shields 38 and 40 allow the first and second shields 38 and 40 to lock between the base 33 and deflector 74.

FIG. 8B depicts a modification to the embodiment of FIG. 8A in which bosses 120 of the releasable fastener 68 are positioned closer to the receiving ends 42 and 48 of the shields 38 and 40. In this configuration, the molded first and second shields 38 and 40 of the single component protector 36 are pried away from each other so that the bosses 120 slide over both the first depending arm 70 and the thermally responsive member 30. When the first and second shields 38 and 40 are released, the single component of the protector 36 flexibly returns to its memory shape and the attachment clearance between the shields is restored. This in turn locks the bosses 120 between the thermally responsive member 30 and the second depending arm 72 to lock the protector 36 in position on the sprinkler head 24.

Figure 9B:
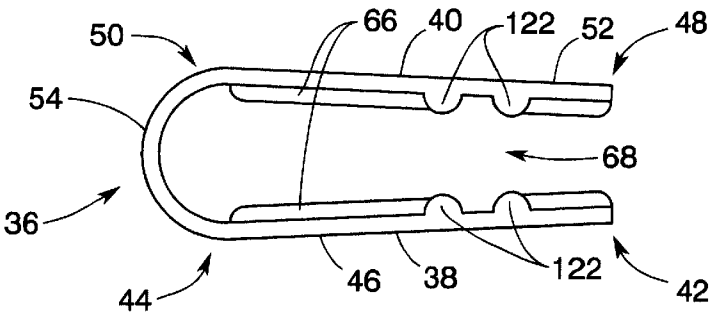
FIG. 9B depicts a protector according to one embodiment of this invention.
Figure 9A:
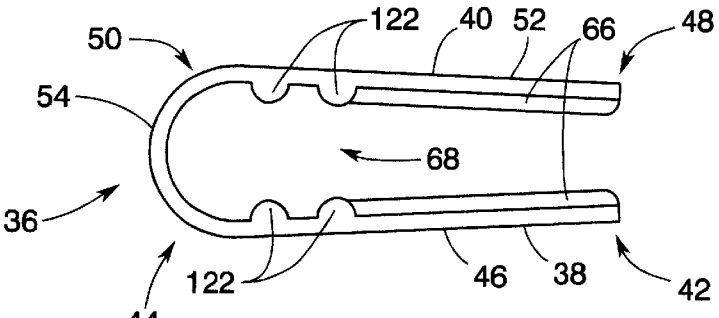
FIG. 9A depicts a protector according to one embodiment of this invention.
Figure 9D:
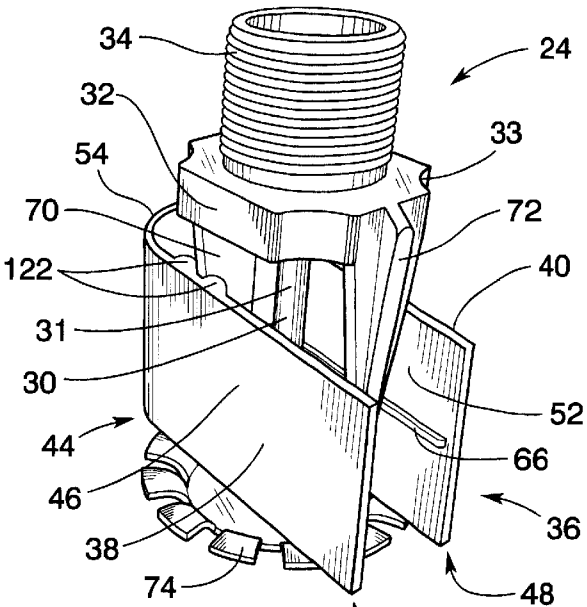
FIG. 9D depicts the protector of FIG. 9A attached to a sprinkler head.
Figure 9C:
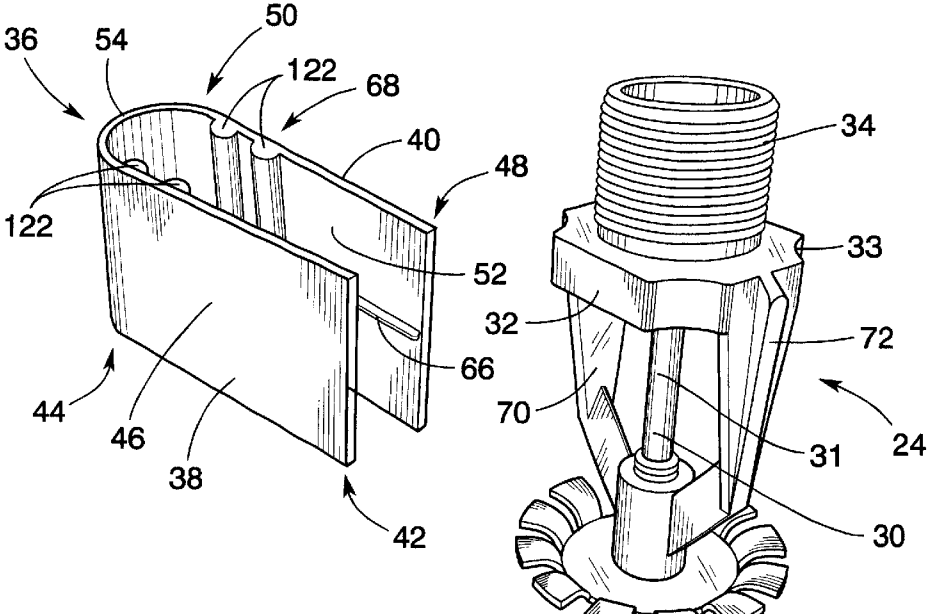
FIG. 9C depicts the protector of FIG. 9A prior to attachment to a sprinkler head.

FIG. 9A depicts an additional embodiment of the invention in which the releasable fastener 68 includes two pairs of positioning lugs 122 rather than a boss, each pair of positioning lugs 122 being positioned opposite the other on the inward sides of the first and second major protective surfaces 46 and 52 of the first and second shields 38 and 40. Referring to FIGS. 9C and 9D, each pair of positioning lugs 122 is configured to directly engage the first depending arm 70 of sprinkler head 24 rather than lock between the depending arm 70 and thermally responsive member 30. During installation, an installer flexibly pries the first shield 38 away from the second shield 40 while sliding the protector 36 on to the sprinkler head 24. The prying action allows for sufficient clearance to exist between the first positioning lug 122 of each pair to slide past the first depending arm 70. The installer then releases the first and second shields 38 and 40 so that the single component of the protector 36 returns to its memory shape, restoring the attachment clearance between the first shield 38 and second shield 40 and engaging the positioning lugs 122 with the first depending arm 70 (as shown in FIG. 9D) to lock the protector 36 in position on the sprinkler head 24.

FIG. 9B depicts an embodiment of the invention similar to that of FIG. 9A, with the protector 36 having positioning lugs 122 that are positioned closer to the receiving ends 42 and 48 of the first and second shields 38 and 40. During installation, an installer flexibly pries the first shield 38 away from the second shield 40 while sliding the protector 36 on to the sprinkler head 24. This prying action allows for sufficient clearance to exist between the pairs of positioning lugs 122 so that lugs 122 can slide past the first depending arm 70 and the thermally responsive member 30. The first of each pair of positioning lugs also slides past the second depending arm 72. The installer then releases the first and second shields 38 and 40 so that the single component of the protector 36 returns to its memory shape, restoring the attachment clearance between the first shield 38 and second shield 40 and engaging the positioning lugs 122 with the second depending arm 70 to lock the protector 36 in position on the sprinkler head 24. It will be appreciated that in some embodiments, the lugs 122 or other similar components may be configured to lock against the depending arms 70 and 72 independently of the memory shape or other separate locking features of the protector 36.

Figure 19B:
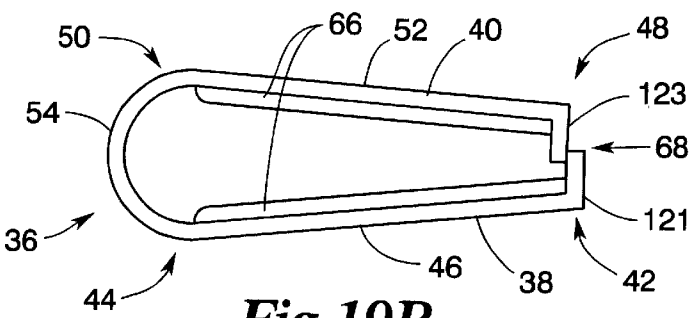
FIG. 19B depicts a protector according to one embodiment of this invention.
Figure 19A:
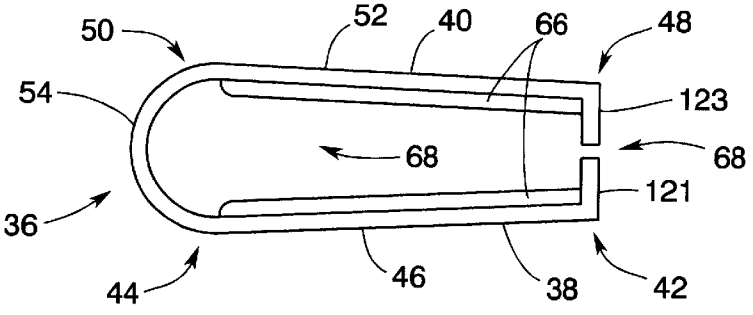
FIG. 19A depicts a protector according to one embodiment of this invention.
Figure 19D:
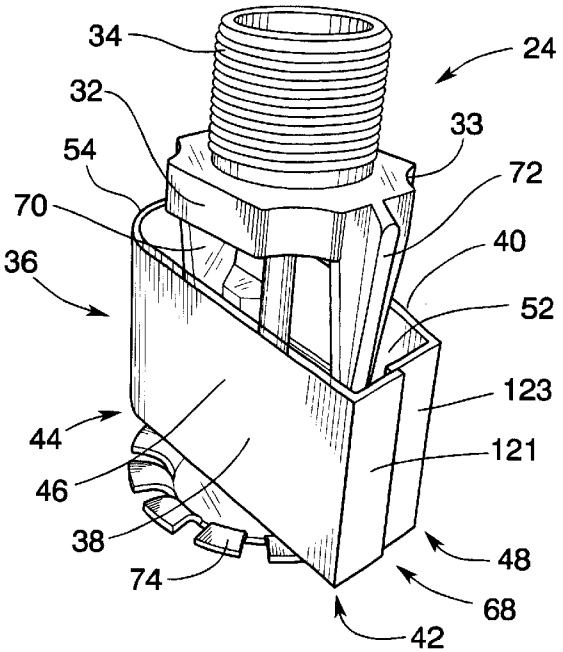
FIG. 19D depicts the protector of FIG. 19A attached to a sprinkler head.
Figure 19C:
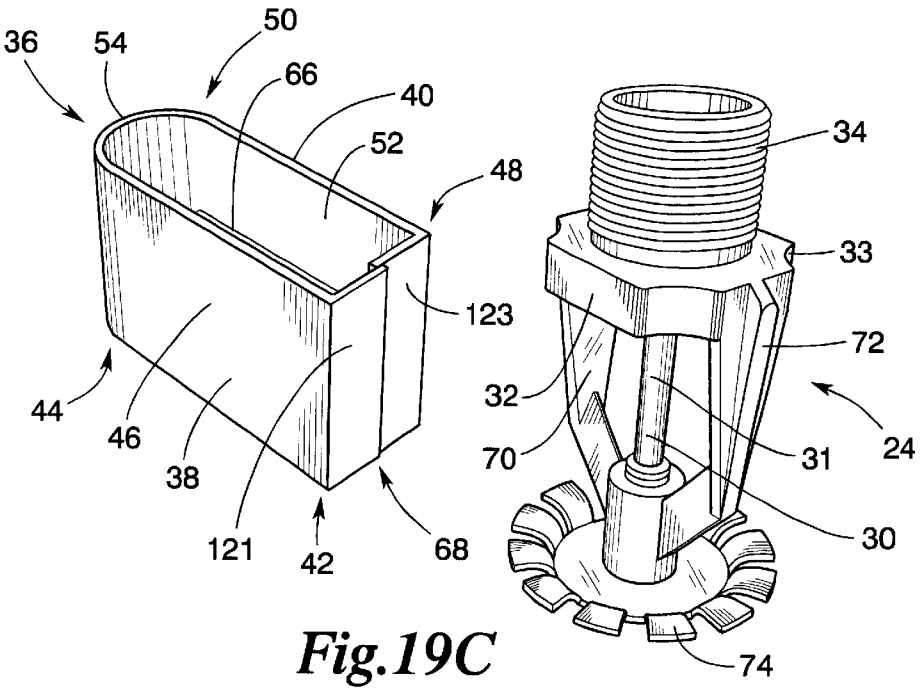
FIG. 19C depicts the protector of FIG. 19B prior to attachment to a sprinkler head.

It will be further appreciated that numerous variations in the design of the releasable fastener used with the protector of the invention are also possible and contemplated to be within the invention scope. For example, FIG. 19A depicts an embodiment of the invention in which the releasable fastener 68 comprises a first protective tab 121 extending inward from the receiving end 42 of the first shield 38 toward the receiving end 48 of the second shield 40, and further comprises a second protective tab 123 extending inward form the receiving end 48 of the second shield 40 toward the receiving end 42 of the first shield 38. FIGS. 19B–D depict a slight modification of the embodiment of FIG. 19A in which the first protective tab 121 overlaps the second protective tab 123.

As with the embodiments depicted in FIGS. 8A–D and 9A–D, the protector 36 of FIG. 19B can be installed on a sprinkler head 24 by prying the first and second shields 38 and 40 away from each other so that the first and second protective tabs 121 and 123 slide over the first depending arm 70, thermally responsive member 30 and second depending arm 72, as shown in FIGS. 19C and D.

As another example, FIGS. 10-C and 12A–C each depict a protector 36 having a releasable fastener 68 that includes a male stanchion 60 mounted on a first tab 126, the first tab 126 extending from the receiving end 42 of the first shield 38. A second tab 128 extends from the receiving end 42 of the second shield 40. A female slot 130 extends through the second tab 128. As best understood with reference to FIGS. 10C and 12C, the male stanchion 60 is configured to engage and lock within the female slot 130 when the protector 36 is attached to a sprinkler head 24 so that the major protective surface 46 of the first shield 38 and the major protective surface 52 of the second shield 40 are positioned proximate to the thermally responsive member 30.

FIGS. 11A–C and 16A–C depict similar releasable fasteners 68, the first tab 126 being an offset tab having a downward offset 132 and the second tab 128 also being an offset tab having an upward offset 134. As best understood by comparing FIGS. 11A with 11C and by comparing FIGS. 16A with 16C, the first tab 126 and second tab 128 are configured so that the downward offset 132 and upward offset 134 each remain unobstructed when the male stanchion 60 is engaged and locked within the female slot 130. During removal of the protector 36 from the sprinkler head 24, an installer can easily disengage the male stanchion 60 from the female slot 130 with two fingers by prying the downward offset 132 away from the upward offset 134 so that the first tab 126 and second tab 128 are drawn apart from each other.

Figure 13A:
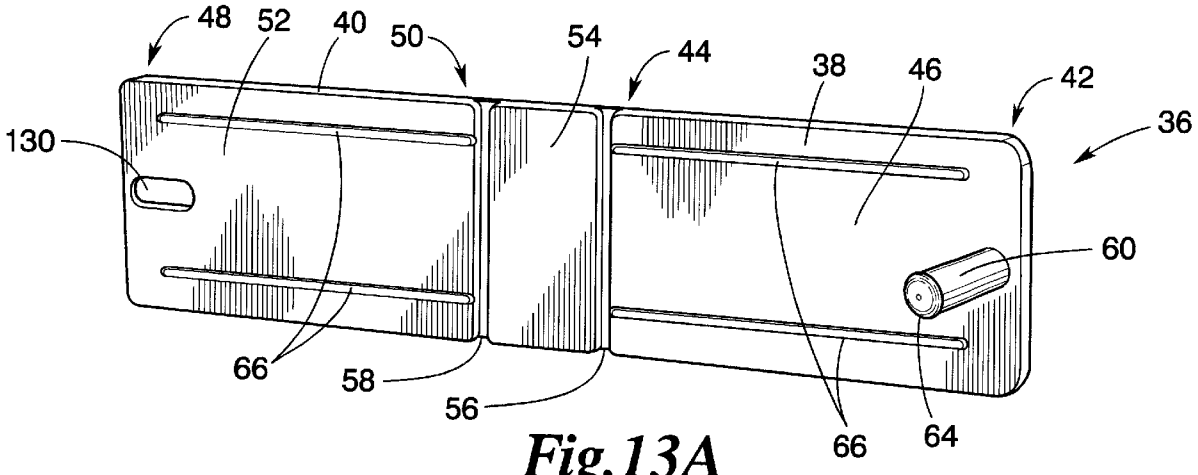
FIG. 13A depicts a protector according to one embodiment of this invention.
Figure 13C:
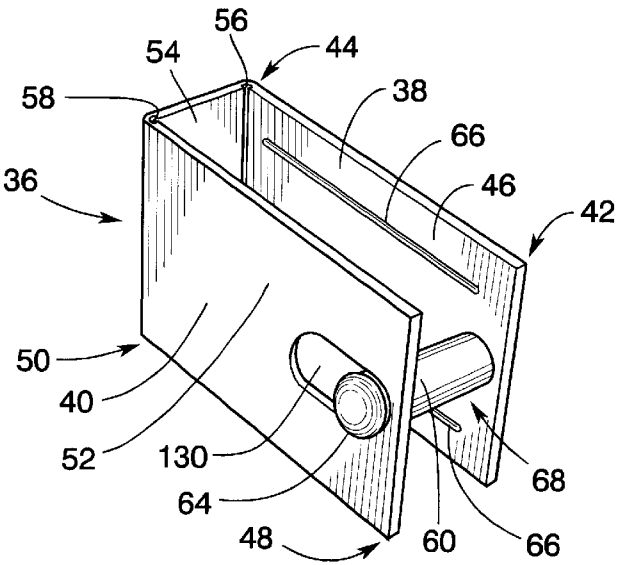
FIG. 13C depicts the protector of FIG. 13A with shields shown rotated as when attached to a sprinkler head.
Figure 13B:
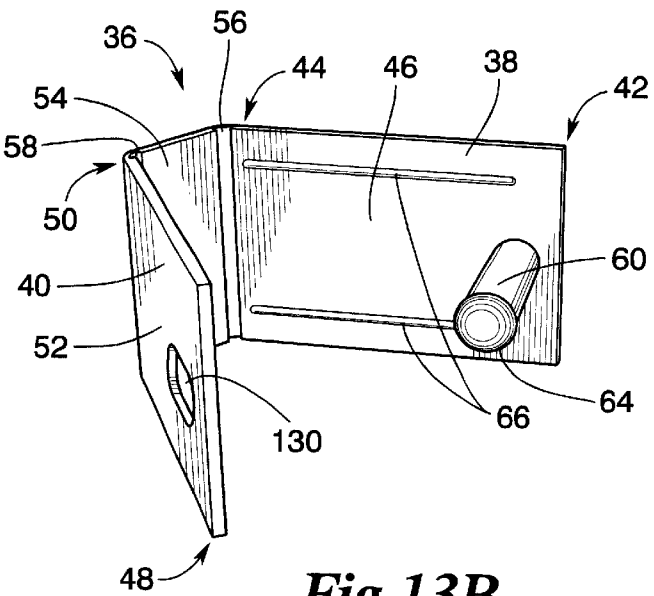
FIG. 13B depicts the protector of FIG. 13A with shields shown rotated prior to attachment to a sprinkler head.

It will be similarly appreciated that this invention can incorporate a variety of releasable fastener designs in which the fastener components are mounted or positioned directly one or more of the major protective surfaces of the shields. For example, FIGS. 13A–C depict a protector 36 having a male stanchion 60 mounted on the first shield 38 and an oval female slot 130 extending through the second shield 40. As best understood with reference to FIG. 13, the female slot 130 permits a limited amount of sliding play by the male stanchion 60 to facilitate installation and removal from a sprinkler head and to increase the overall flexibility of the protector 36.

Figure 14A:
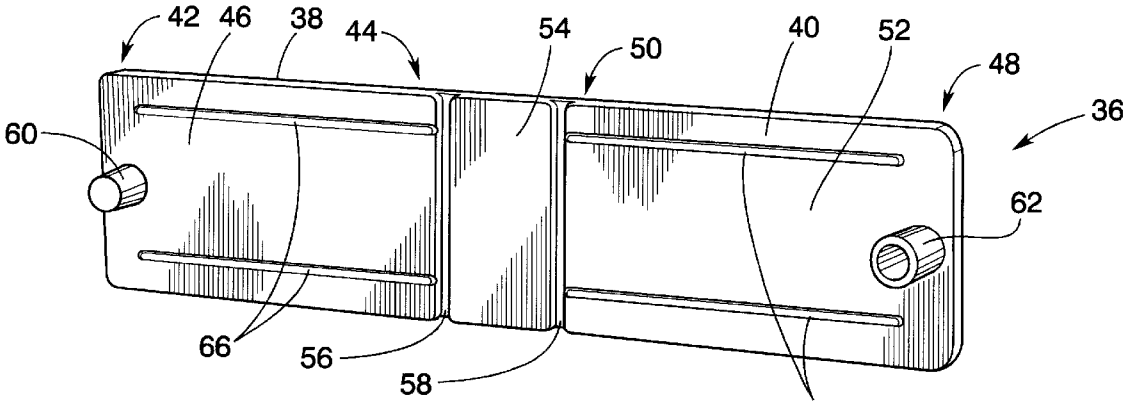
FIG. 14A depicts a protector according to one embodiment of this invention.
Figure 14C:
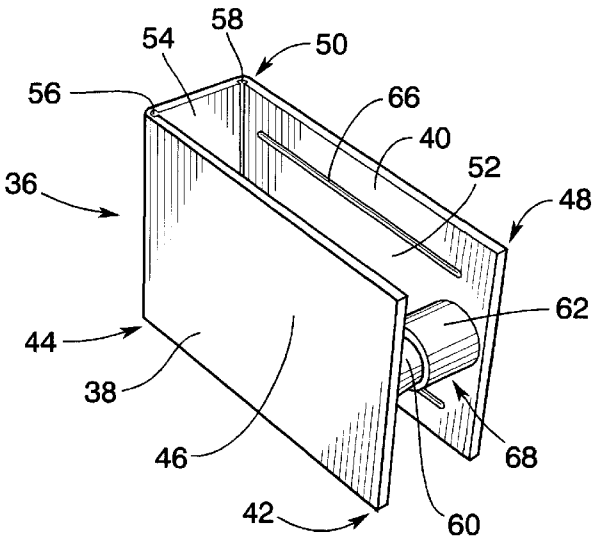
FIG. 14C depicts the protector of FIG. 14A with shields shown rotated as when attached to a sprinkler head.
Figure 14B:
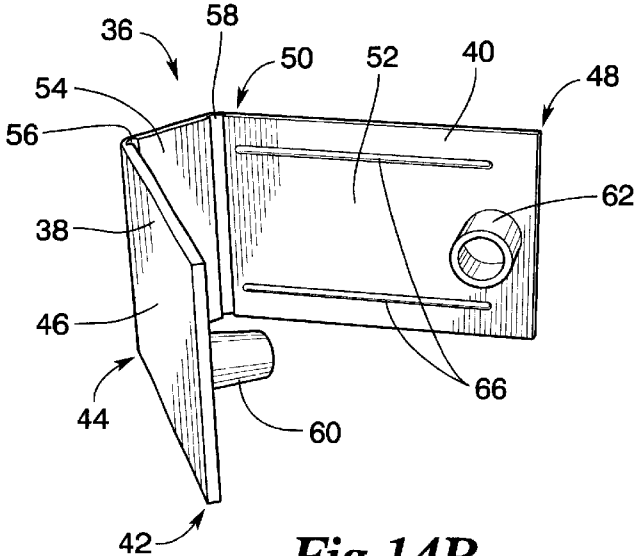
FIG. 14B depicts the protector of FIG. 14A with shields shown rotated prior to attachment to a sprinkler head.

FIGS. 14A–C depict a protector 36 similar to the protector of FIGS. 3A–C but without a lip on the male stanchion 60. In this embodiment of the invention, the male stanchion 60 is slightly tapered to permit frictional engagement with the female stanchion 62 when the protector 36 is attached to a sprinkler head, allowing for easier removal of the protector after the installation of the sprinkler.

Figure 15A:
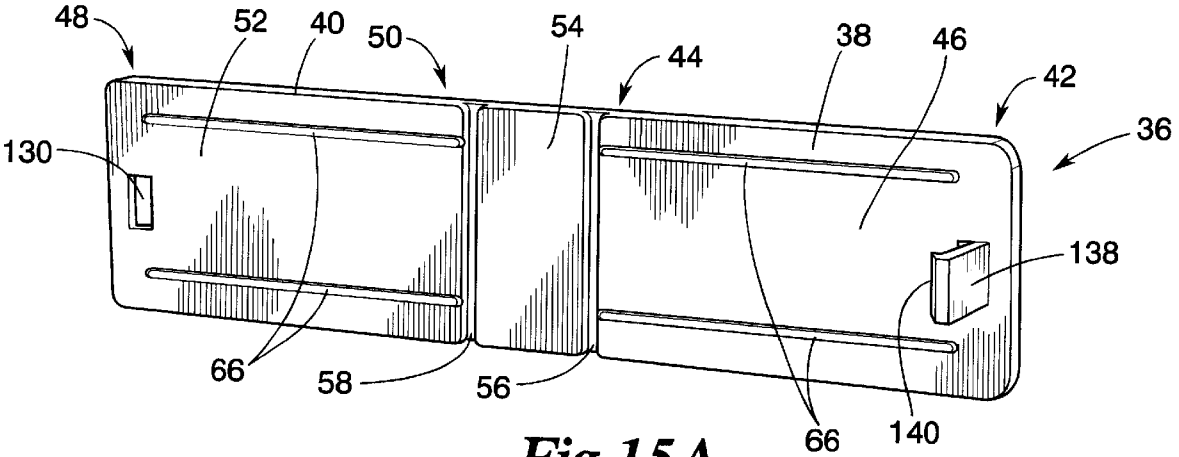
FIG. 15A depicts a protector according to one embodiment of this invention.
Figure 15C:
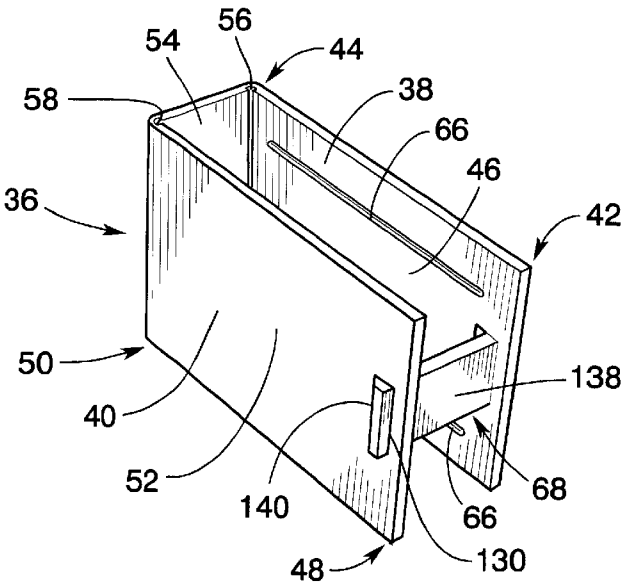
FIG. 15C depicts the protector of FIG. 15A with shields shown rotated as when attached to a sprinkler head.
Figure 15B:
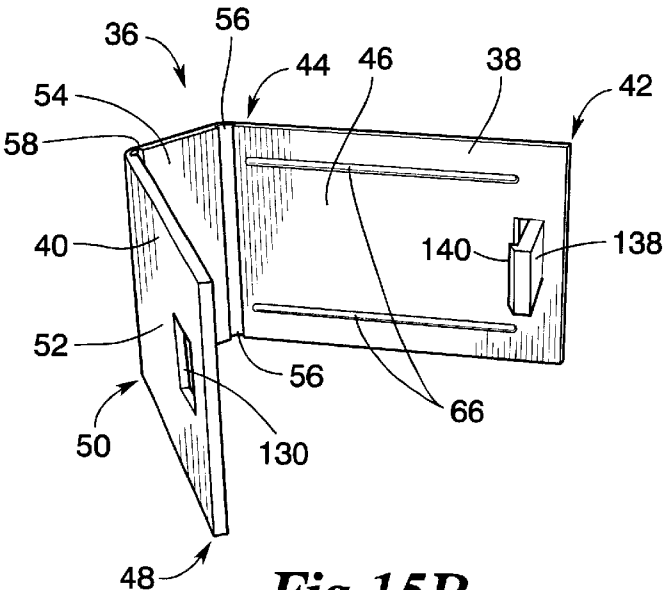
FIG. 15B depicts the protector of FIG. 15A with shields shown rotated prior to attachment to a sprinkler head.

FIGS. 15A–C depict a protector 36 having a male hook 138 extending from the first shield 38, the male hook 138 having a tapered hook edge 140 and being positioned to engage and lock within a rectangular shaped female slot 130 on the second shield 40 when the protector 36 is attached to a sprinkler head. As best understood with reference to FIG. 15C, after the protector 36 has been attached to a sprinkler head, the male hook 138 can be easily disengaged from the female slot 130 by pushing the tapered hook edge 140 toward the receiving end 48 of the second shield 40, or alternatively by pushing the receiving end 48 of the second shield 40 toward the cross member 54 of the protector 36. This permits the hook edge 140 to pass unobstructed through the female slot 130 and disengage the fastener 68.

It will be further appreciated that the releasable fastener or other features of the invention may include one or more components that are not integral to the molded or otherwise constructed structure of the protector while remaining within the intended invention scope. As illustrative examples, FIGS. 17A–C and 18A–C depict embodiments of the invention in which the depicted releasable fasteners include such non-integral components.

Figure 17A:
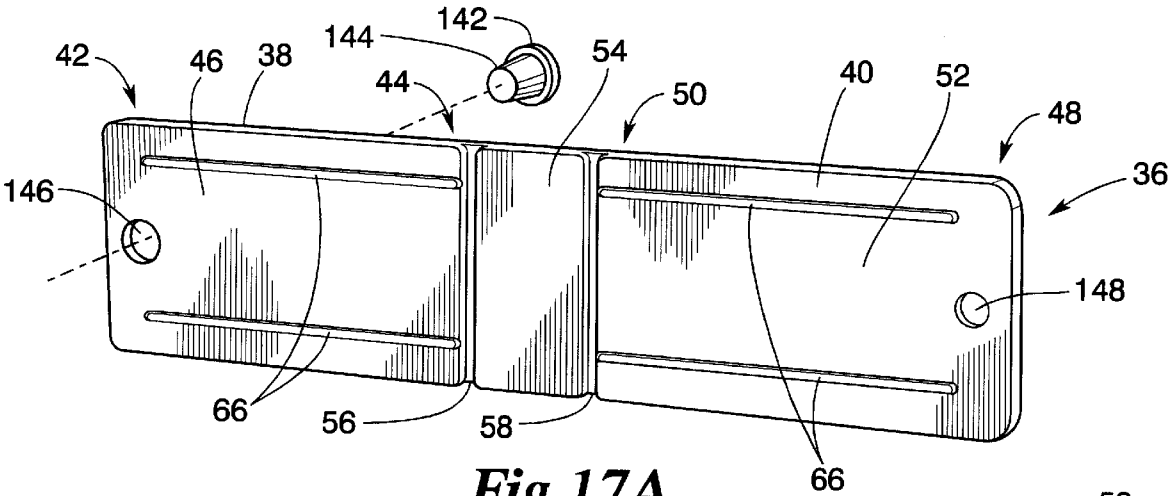
FIG. 17A depicts a protector according to one embodiment of this invention.
Figure 17C:
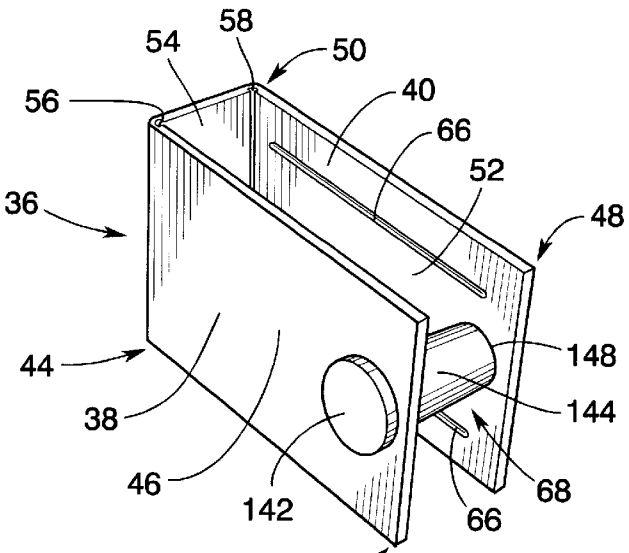
FIG. 17C depicts the protector of FIG. 17A with shields shown rotated as when attached to a sprinkler head.
Figure 17B:
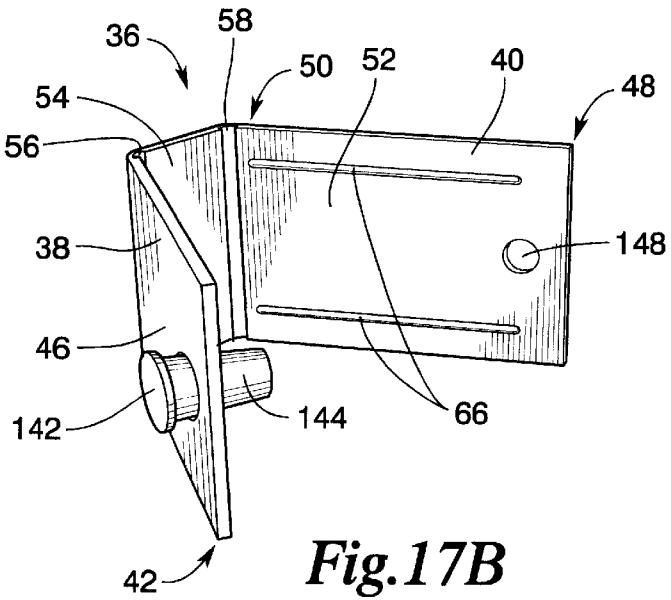
FIG. 17B depicts the protector of FIG. 17A with shields shown rotated prior to attachment to a sprinkler head.

Referring to FIGS. 17A–C, a protector 36 is depicted in which a releasable fastener 68 includes a friction pin 142 having a tapered insertion surface 144. The insertion surface 144 is inserted through an insertion slot 146 extending through the first shield 38. When attached to a sprinkler head, the protector 36 is secured in position by further inserting the friction pin 142 through a locking slot 148 that extends through the second shield 40 so that the tapered insertion surface 144 frictionally engages and locks inside the locking slot 148.

Figure 18A:
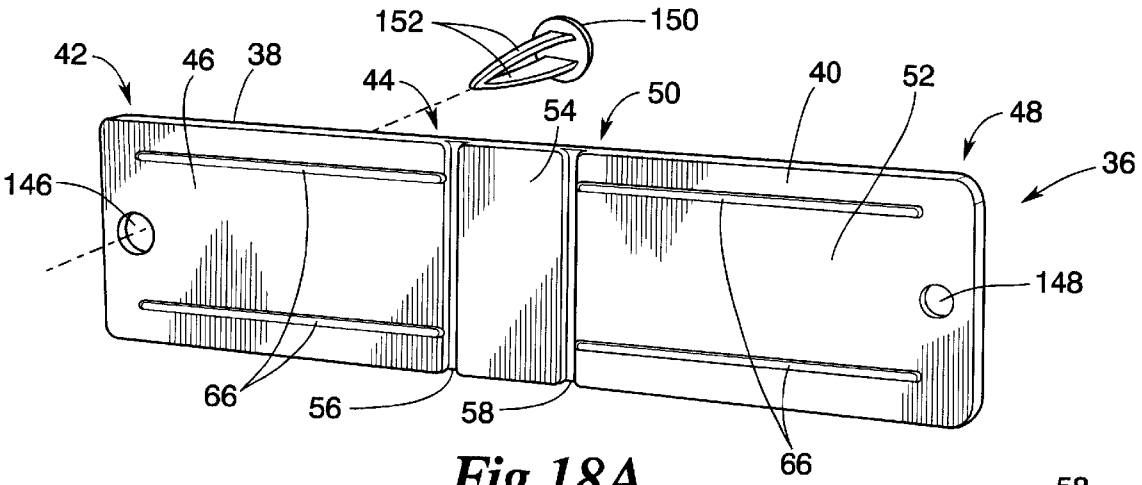
FIG. 18A depicts a protector according to one embodiment of this invention.
Figure 18C:
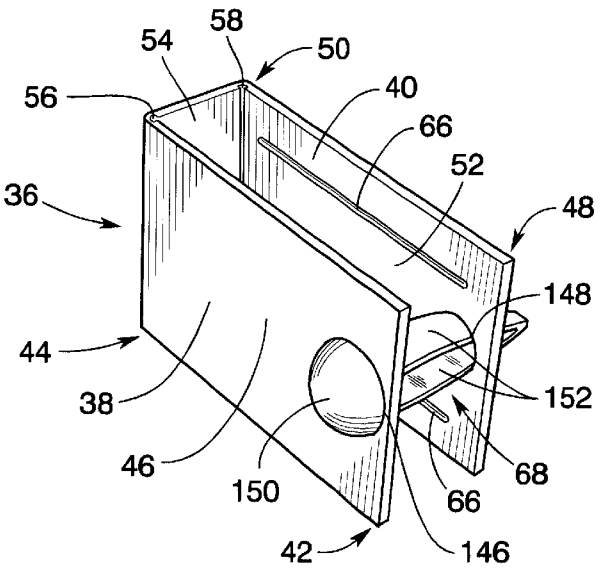
FIG. 18C depicts the protector of FIG. 18A with shields shown rotated as when attached to a sprinkler head.
Figure 18B:
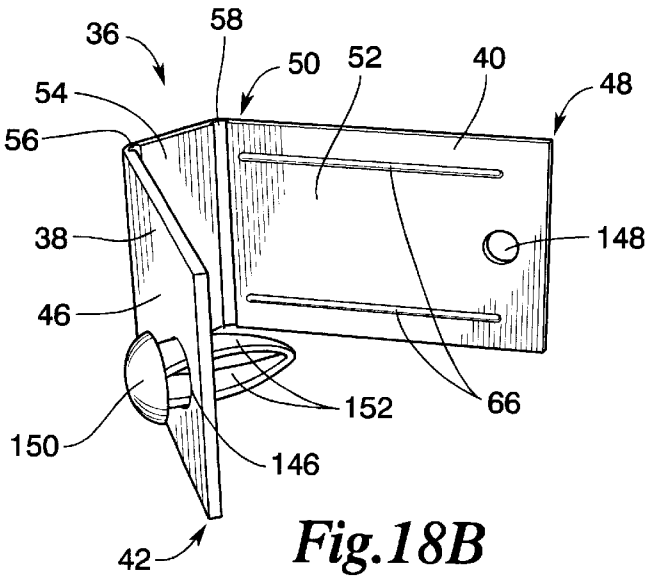
FIG. 18B depicts the protector of FIG. 18A with shields shown rotated prior to attachment to a sprinkler head.

A similar protector 36 is depicted in FIGS. 18A–C. However, the releasable fastener 68 of the protector 36 includes a tension pin 150 having a pair of tapered tension struts 152 which are inserted into insertion slot 146 and further inserted into locking slot 148 when the protector 36 is attached to a sprinkler head. When compressively inserted into the locking slot 148, as shown in FIG. 18C, each of the tension struts 152 of the tension pin 150 exert outward tension forces against the inside surface of the locking slot 148 to frictionally engage the second shield 40 to lock the protector 36 to the sprinkler head. The releasable fastener 68 can then be easily removed by prying the first shield 38 away from the second shield 40 or by pinching the tension struts to disengage the tension pin 150 from the locking slot 148.

Many other modifications and changes can be made to the protector of this invention by those skilled in the relevant art without departing from the spirit and scope of this invention. Thus, the claims, when appended, are intended to be interpreted to cover such equivalent protectors as do not depart from the spirit and scope of this invention.

What is claimed is:

1. A removable protector for protecting a thermally responsive member of a sprinkler head from damage while said protector is attached to the sprinkler head, the thermally responsive member having a surface area which includes an exposed portion that is capable of making contact with objects that are external to the sprinkler head, said protector comprising:

a first shield and a second shield, each of said first and second shields having a receiving end and a connecting end, each of said first and second shields having a major protective surface which extends at least partially along the exposed portion of the surface area of the thermally responsive member when said protector is attached to the sprinkler head;

a cross member connected to each said connecting end of each of said first and second shields;

a releasable fastener which attaches said protector to the sprinkler head and secures said major protective surfaces of said first and second shields to positions that are proximate the exposed portions of the surface area of the thermally responsive member to provide continuous protection of the thermally responsive member from objects that are external to the sprinkler head while said protector is attached to the sprinkler head.

2. The removable protector for protecting a thermally responsive member of a sprinkler head of claim 1, said releasable fastener further comprising:

a male stanchion mounted on said first shield proximate said receiving end of said first shield;

a female stanchion mounted on said second shield proximate said receiving end of said second shield; said male stanchion being positioned to engage and lock within said female stanchion to secure said protector in place when said major protective surfaces of said first and second shields are proximate the exposed portions of the surface area of the thermally responsive member of the sprinkler head.

3. The removable protector for protecting a thermally responsive member of a sprinkler head of claim 1, said releasable fastener further comprising:

a male hook mounted on said first shield proximate said receiving end of said first shield;

a female slot extending through said second shield proximate said receiving end of said second shield;

said male hook being positioned to engage and lock within said female slot to secure said protector in place when said major protective surfaces of said first and second shields are proximate the exposed portions of the surface area of the thermally responsive member of the sprinkler head.

4. The removable protector for protecting a thermally responsive member of a sprinkler head of claim 1, said releasable fastener further comprising:

a male stanchion mounted on a first tab, said first tab mounted on said first shield proximate said receiving end of said first shield;

a female slot mounted on a second tab, said second tab mounted on said second shield proximate said receiving end of said second shield;

said male stanchion being positioned to engage and lock within said female slot to secure said protector in place when said major protective surfaces of said first and second shields are proximate the exposed portions of the surface area of the thermally responsive member of the sprinkler head.

5. The removable protector for protecting a thermally responsive member of a sprinkler head of claim 1, said releasable fastener further comprising:

a male stanchion mounted on a first offset tab, said first offset tab mounted on said first shield proximate said receiving end of said first shield;

a female slot mounted on a second offset tab, said second offset tab mounted on said second shield proximate said receiving end of said second shield;

said male stanchion being positioned to engage and lock within said female slot to secure said protector in place when said first and second offset tabs are slightly twisted and when said major protective surfaces of said first and second shields are proximate the exposed portions of the surface area of the thermally responsive member of the sprinkler head.

6. The removable protector for protecting a thermally responsive member of a sprinkler head of claim 1, said cross member being connected to said connecting end of said first shield with a first living hinge, said first living hinge allowing said first shield to be rotated about said first living hinge to variable angles with respect to said cross member, said cross member being connected to said connecting end of said second shield with a second living hinge, said second living hinge allowing said second shield to be rotated about said second living hinge to variable angles with respect to said cross member.

7. The removable protector for protecting a thermally responsive member of a sprinkler head of claim 1, the sprinkler head having a base with depending arms extending therefrom, the depending arms separated from each other by a depending arm space, the depending arms positioning a deflector at a position that is distal the base of the sprinkler head and separated therefrom by a deflector space, the deflector having a deflector width, the depending arms extending along either side of the thermally responsive member, and the base of the sprinkler head having a base width, said protector further comprising:

said first and second shields each having preselected lengths that permit each of said first and second shields to extend fully along the depending arm space between the depending arms when said protector is attached to the sprinkler head;

said first and second shields each having preselected heights that permit said major protective surfaces of said first and second shields to extend along the exposed portion of the surface area of the thermally responsive member, said preselected heights of said first and second shields permitting said first and second shields to fit within the deflector space, said preselected lengths and heights of said first and second shields thereby permitting said major protective surfaces of said first and second shields to provide continuous protection of said thermally responsive member while said protector is attached to the sprinkler head;

said cross member of said protector having a width that is less than the base width of the sprinkler head and that is less than the deflector width so that said major protective surfaces of said first and second shields are spaced apart from each other by an attachment clearance when said protector is attached to the sprinkler head, said attachment clearance being less than said base width of the sprinkler head and less than said deflector width wherein said major protective surfaces are locked in positions to protect the thermally responsive member when said protector is attached to the sprinkler head.

8. The removable protector for protecting a thermally responsive member of a sprinkler head of claim 1, the sprinkler head having a base, the base having a base width and a plurality of gripping surfaces for engaging an installation tool, said first and second shields of said protector being separated by an attachment clearance when said protector is attached to the sprinkler head, said attachment clearance being less than the base width wherein an installation tool can engage the gripping surfaces of the sprinkler head without requiring removal of said protector from the sprinkler head.

9. The removable protector for protecting a thermally responsive member of a sprinkler head of claim 1, the sprinkler head having a base with depending arms extending therefrom, the depending arms separated from each other by a depending arm space, the depending arms positioning a deflector at a position that is distal the base of the sprinkler head and separated therefrom by a deflector space, the deflector having a deflector width, the depending arms extending along either side of the thermally responsive member, the base of the sprinkler head having a base width and a plurality of tool gripping surfaces for engaging the inside surface of an installation tool, said protector further comprising:

said first and second shields each having lengths that permit each of said first and second shields to extend fully along the depending arm space between the depending arms when said protector is attached to the sprinkler head, said first and second shields each having heights that are large enough to permit said major protective surfaces of said first and second shields to extend along the exposed portion of the surface area of the thermally responsive member, and short enough to allow said first and second shields to fit within the deflector space, said lengths and heights of said first and second shields thereby permitting said major protective surfaces of said first and second shields to provide continuous protection of the thermally responsive member while said protector is attached to the sprinkler head;

said cross member of said protector having a width that is less than the base width of the sprinkler head and that is less than the deflector width so that said major protective surfaces of said first and second shields are spaced apart from each other by an attachment clearance when said protector is attached to the sprinkler head; and said attachment clearance being less than said base width of the sprinkler head and less than said deflector width so that said major protective surfaces are locked in positions to protect the thermally responsive member when said protector is attached to the sprinkler head and to allow an installation tool to engage the gripping surfaces of the sprinkler head without requiring removal of said protector from the sprinkler head.

10. The removable protector for protecting a thermally responsive member of a sprinkler head of claim 1, the sprinkler head having a base, the base having a base width and a plurality of gripping surfaces for engaging an installation tool, said first and second shields of said protector being separated by an attachment clearance when said protector is attached to the sprinkler head, said attachment clearance being less than the base width to allow an installation tool to engage the gripping surfaces of the sprinkler head during installation of the sprinkler head on a mounting plate without requiring removal of said protector from the sprinkler head.

11. The removable protector for protecting a thermally responsive member of a sprinkler head of claim 1, the sprinkler head being mounted on a mounting plate, the mounting plate having an outside diameter for engaging an escutcheon plate, the escutcheon plate having an inside diameter for engaging the mounting plate, said protector having a length that permits the outside diameter of the mounting plate to engage the inside diameter of the escutcheon plate while said protector remains attached to the sprinkler head and while the sprinkler head remains mounted on the mounting plate.

12. The removable protector for protecting a thermally responsive member of a sprinkler head of claim 1, said first and second shields each having preselected lengths that permit the sprinkler head to be stored in a multiple unit carton while said protector is attached to the sprinkler head.

13. The removable protector for protecting a thermally responsive member of a sprinkler head of claim 1, the sprinkler head having a base with depending arms extending therefrom and defining a bisecting plane having first and second bisecting plane sides, the depending arms separated from each other by a depending arm space, the depending arms positioning a side deflector at a position that is distal the base of the sprinkler head and separated therefrom by a first deflector space in the first bisecting plane side and by a second deflector space in the second bisecting plane side, the side deflector having a deflector width, the depending arms extending along either side of the thermally responsive member, and the base of the sprinkler head having a base width, said protector further comprising:

said first and second shields each having a preselected length which permits each of said first and second shields to extend fully along the depending arm space between the depending arms when said protector is attached to the sprinkler head;

said first shield having a preselected height which permits said major protective surface of said first shield to extend along the exposed portion of the surface area of the thermally responsive member in the first bisecting plane side, said second shield having a preselected height which permits said major protective surface of said second shield to extend along the exposed portion of the surface area of the thermally responsive member in the second bisecting plane side, said preselected height of said first shield permits said first shield to fit within the first deflector space in the first bisecting plane side, said preselected height of said second shield permits said second shield to fit within the second deflector space in the second bisecting plane side;

said cross member of said protector having a width that is less than the base width of the sprinkler head and that is less than the deflector width so that said major protective surfaces of said first and second shields are spaced apart from each other by an attachment clearance when said protector is attached to the sprinkler head, said attachment clearance being less than the base width of the sprinkler head and less than the deflector width wherein said major protective surfaces are locked in positions to protect the thermally responsive member when said protector is attached to the sprinkler head.

14. The removable protector for protecting a thermally responsive member of a sprinkler head of claim 1, the sprinkler head having a base with depending arms extending therefrom, the depending arms separated from each other by a depending arm space, the depending arms positioning a deflector at a position that is distal the base of the sprinkler head and separated therefrom by a deflector space, the deflector including a side deflector panel separated from the base of the sprinkler by a side deflector panel space, the deflector having a deflector width, the depending arms extending along either side of the thermally responsive member, and the base of the sprinkler head having a base width, said protector further comprising:

said first and second shields each having lengths that permit each of said first and second shields to extend fully along the depending arm space between the depending arms when said protector is attached to the sprinkler head, said first and second shields each having preselected heights that permit said major protective surfaces to extend along the exposed portion of the surface area of the thermally responsive member and permit said first and second shields to fit within the deflector space, said lengths and heights of said first and second shields thereby permitting said major protective surfaces of said first and second shields to provide continuous protection of the thermally responsive member while said protector is attached to the sprinkler head;

said cross member of said protector having a width that is significantly less than the base width of the sprinkler head and that is less than the deflector width so that said major protective surfaces of said first and second shields are spaced apart from each other by an attachment clearance when said protector is attached to the sprinkler head, said attachment clearance being less than the base width of the sprinkler head and less than the deflector width wherein said major protective surfaces are locked in positions to protect the thermally responsive member when said protector is attached to the sprinkler head;

said protector having a side deflector panel accommodation notch, said side deflector panel accommodation notch being positioned to allow clearance for the side deflector panel wherein said protector fits within the side deflector panel space between the side deflector panel and the base of the sprinkler head when said protector is attached to the sprinkler head.

15. The removable protector for protecting a thermally responsive member of a sprinkler head of claim 1, the sprinkler head having a base with depending arms extending therefrom, said releasable fastener comprising a first boss mounted to said first shield and a second boss mounted to said second shield, said first boss and said second boss being positioned to engage the sprinkler head between the thermally responsive member and at least one of the depending arms of the sprinkler head when said protector is attached to the sprinkler head.

16. The removable protector for protecting a thermally responsive member of a sprinkler head of claim 1, the sprinkler head having a base with depending arms extending therefrom, said releasable fastener comprising a first pair of positioning lugs mounted to said first shield and a second pair of positioning lugs mounted to said second shield, each of said first pair of positioning lugs and said second pair of positioning lugs being positioned to cause said fastener to engage the sprinkler head at at least one of the depending arms of the sprinkler head when said protector is attached to the sprinkler head.

17. The removable protector for protecting a thermally responsive member of a sprinkler head of claim 1, the sprinkler having a deflector mounted thereon, the deflector having a width, said protector further comprising:

said cross member having a width of a preselected size that said major protective surfaces of said first and second shields are spaced apart from each other by an attachment clearance that is less than the width of the deflector;

said major protective surface of said first shield having a first slot and said major protective surface of said second shield having a second slot, said first and second slots being positioned to accept a portion of the width of the deflector that exceeds said attachment clearance between said first and second shields.

18. The removable protector for protecting a thermally responsive member of a sprinkler head of claim 1, said protector further comprising an enclosure comprising:

a first enclosure surface extending from said connecting end of each of said first and second shields, said first enclosure surface of said first shield extending inward toward said second shield when said protector is attached to said sprinkler head, said first enclosure surface of said second shield extending inward toward said first shield when said protector is attached to said sprinkler head;

a second enclosure surface extending between said connecting end and said receiving end of each of said first and second shields, said second enclosure surface of said first shield extending inward toward said second shield when said protector is attached to said sprinkler head, said second enclosure surface of said second shield extending inward toward said first shield when said protector is attached to said sprinkler head;

a third enclosure surface extending from said receiving end of each of said first and second shields, said third enclosure surface of said first shield extending inward toward said second shield when said protector is attached to said sprinkler head, said third enclosure surface of said second shield extending inward toward said first shield when said protector is attached to said sprinkler head.

19. The removable protector for protecting a thermally responsive member of a sprinkler head of claim 1, the sprinkler having a deflector mounted thereon, the deflector having a width, said protector further comprising:

said cross member having a width of a preselected size that said major protective surfaces of said first and second shields are spaced apart from each other by an attachment clearance that is less than the width of the deflector;

said major protective surface of said first shield having a first slot and said major protective surface of said second shield having a second slot, said first and second slots being positioned to accept a portion of the width of the deflector that exceeds said attachment clearance between said first and second shields;

an enclosure, said enclosure having a first enclosure surface extending from said connecting end of each of said first and second shields, said first enclosure surface of said first shield extending inward toward said second shield when said protector is attached to said sprinkler head, said first enclosure surface of said second shield extending inward toward said first shield when said protector is attached to said sprinkler head;

said enclosure having a second enclosure surface extending between said connecting end and said receiving end of each of said first and second shields, said second enclosure surface of said first shield extending inward toward said second shield when said protector is attached to said sprinkler head, said second enclosure surface of said second shield extending inward toward said first shield when said protector is attached to said sprinkler head; and said enclosure having a third enclosure surface extending from said receiving end of each of said first and second shields, said third enclosure surface of said first shield extending inward toward said second shield when said protector is attached to said sprinkler head, said third enclosure surface of said second shield extending inward toward said first shield when said protector is attached to said sprinkler head.

20. The removable protector for protecting a thermally responsive member of a sprinkler head of claim 1, said cross member having a width defining an attachment clearance between said first and second shields, the thermally responsive member of the sprinkler head having a dimension that extends beyond said attachment clearance, said first shield having an expanded radius to accommodate the dimension of the sprinkler that extends beyond said attachment clearance.

21. The removable protector for protecting a thermally responsive member of a sprinkler head of claim 1, said cross member having a width defining an attachment clearance between said first and second shields, the thermally responsive member of the sprinkler head having a dimension that extends beyond said attachment clearance, each of said first and second shields having an expanded radius to accommodate the dimension of the sprinkler that extends beyond said attachment clearance.

22. The removable protector for protecting a thermally responsive member of a sprinkler head of claim 1, said releasable fastener further comprising:

a male stanchion mounted on said major protective surface of said first shield proximate said receiving end of said first shield;

a female stanchion mounted on said major protective surface of said second shield proximate said receiving end of said second shield;

said male stanchion being positioned to engage said female stanchion under compression to secure said protector in place when said major protective surfaces of said first and second shields are proximate the exposed portions of the surface area of the thermally responsive member of the sprinkler head.

23. The removable protector for protecting a thermally responsive member of a sprinkler head of claim 1, said releasable fastener further comprising:

a first slot extending through said major protective surface of said first shield proximate said receiving end of said first shield;

a second slot extending through said major protective surface of said second shield proximate said receiving end of said second shield;

a connection pin extending through said first slot in said first shield, said connection pin positioned to be inserted into and to engage said second slot in said second shield to secure said protector in place when said major protective surfaces of said first and second shields are proximate the exposed portions of the surface area of the thermally responsive member of the sprinkler head.

24. The removable protector for protecting a thermally responsive member of a sprinkler head of claim 23, said connection pin is a friction pin.

25. The removable protector for protecting a thermally responsive member of a sprinkler head of claim 23, said connection pin is a tension pin.

26. The removable protector for protecting a thermally responsive member of a sprinkler head of claim 1, the sprinkler head having a sprinkler head color, said protector has a protector color that contrasts the sprinkler head color to increase visibility of said protector from a distance when said protector is attached to the sprinkler head.

27. The removable protector for protecting a thermally responsive member of a sprinkler head of claim 1, the sprinkler head having a sprinkler head color, said protector has a fluorescent color that contrasts the sprinkler head color to increase visibility of said protector from a distance when said protector is attached to the sprinkler head.

28. The removable protector for protecting a thermally responsive member of a sprinkler head of claim 1, the sprinkler head having a base with depending arms extending therefrom, said protector being formed from a single flexible component having said connecting ends of said first and second shields flexibly molded to said cross member, said releasable fastener comprising a first boss mounted to said first shield and a second boss mounted to said second shield, said protector having a memory shape to cause said fastener to engage the sprinkler head between the thermally responsive member and at least one of the depending arms of the sprinkler head when said protector is attached to the sprinkler head.

29. The removable protector for protecting a thermally responsive member of a sprinkler head of claim 1, the sprinkler head having a base with depending arms extending therefrom, said protector being formed from a single flexible component having said connecting ends of said first and second shields flexibly molded to said cross member, said releasable fastener comprising a first pair of positioning lugs mounted to said first shield and a second pair of positioning lugs mounted to said second shield, said protector having a memory shape to cause said fastener to engage the sprinkler head at at least one of the depending arms of the sprinkler head when said protector is attached to the sprinkler head.

30. The removable protector for protecting a thermally responsive member of a sprinkler head of claim 1, said releasable fastener further comprising:

a first protective tab extending inward from said receiving end of said first shield toward said receiving end of said second shield;

a second protective tab extending inward from said receiving end of said second shield toward said receiving end of said first shield.

31. A removable protector for protecting a thermally responsive member of a sprinkler head from damage while said protector is attached to the sprinkler head, the sprinkler head having a base with depending arms extending therefrom, the depending arms separated from each other by a depending arm space, the depending arms positioning a deflector at a position that is distal the base of the sprinkler head and separated therefrom by a deflector space, the deflector having a deflector width, the depending arms extending along either side of the thermally responsive member, the base of the sprinkler head having a base width and a plurality of tool gripping surfaces for engaging the inside surface of an installation tool, the thermally responsive member having a surface area which includes an exposed portion that is capable of making contact with objects that are external to the sprinkler head, said protector further comprising:

a first shield and a second shield, each of said first and second shields having a receiving end and a connecting end, each of said first and second shields having a major protective surface which extends along the exposed portion of the surface area of the thermally responsive member when said protector is attached to the sprinkler head;

a cross member connected to each said connecting end of each of said first and second shields, said cross member being connected to said connecting end of said first shield with a first living hinge, said first living hinge allowing said first shield to be rotated about said first living hinge to variable angles with respect to said cross member, said cross member being connected to said connecting end of said second shield with a second living hinge, said second living hinge allowing said second shield to be rotated about said second living hinge to variable angles with respect to said cross member;

a releasable fastener including a male stanchion mounted on said major protective surface of said first shield proximate said receiving end of said first shield and a female stanchion mounted on said major protective surface of said second shield proximate said receiving end of said second shield, said male stanchion being positioned to engage and lock within said female stanchion when said major protective surfaces of said first and second shields are proximate the exposed portions of the surface area of the thermally responsive member of the sprinkler head to provide continuous protection of the thermally responsive member from objects that are external to the sprinkler head while said protector is attached to the sprinkler head;

said first and second shields each having preselected lengths that permit each of said first and second shields to extend along the depending arm space between the depending arms when said protector is attached to the sprinkler head, said first and second shields each having preselected heights that permit said major protective surfaces to extend along the exposed portion of the surface area of the thermally responsive member, said first and second shields also having preselected heights that permit said first and second shields to fit within the deflector space, said lengths and heights of said first and second shields thereby permitting said first and second shields to provide continuous protection of the thermally responsive member while said protector is attached to the sprinkler head;

said cross member of said protector having a width that is less than the base width of the sprinkler head and that is less than the deflector width so that said major protective surfaces of said first and second shields are spaced apart from each other by an attachment clearance when said protector is attached to the sprinkler head, said attachment clearance being less than said base width of the sprinkler head and being less than said deflector width wherein said major protective surfaces are locked in positions to protect the thermally responsive member when said protector is attached to the sprinkler head;

said attachment clearance also being less than said base width to permit an installation tool to engage said tool gripping surfaces for installing the sprinkler head while said protector is attached to the sprinkler head.

32. A removable protector for protecting a thermally responsive member of a sprinkler head from damage while said protector is attached to the sprinkler head, the thermally responsive member having a surface area which includes an exposed portion that is capable of making contact with objects that are external to the sprinkler head, said protector comprising:

a first shield and a second shield, each of said first and second shields having a first end and a second end, each of said first and second shields having a major protective surface which extends at least partially along the exposed portion of the surface area of the thermally responsive member when said protector is attached to the sprinkler head;

a cross member connected to said second end of each of said first and second shields;

a releasable fastener which attaches said protector to the sprinkler head and secures said major protective surfaces of said first and second shields to positions that are proximate the exposed portions of the surface area of the thermally responsive member to provide continuous protection of the thermally responsive member from objects that are external to the sprinkler head while said protector is attached to the sprinkler head;

said first end of each of said shields being adjacent one another and said second ends of each of said shields being adjacent one another when said protector is attached to a sprinkler head.

33. The removable protector for protecting a thermally responsive member of a sprinkler head of claim 32, said releasable fastener further comprising:

a male stanchion mounted on said first shield proximate said first end of said first shield;

a female stanchion mounted on said second shield proximate said first end of said second shield;

said male stanchion being positioned to engage and lock within said female stanchion to secure said protector in place when said major protective surfaces of said first and second shields are proximate the exposed portions of the surface area of the thermally responsive member of the sprinkler head.

34. The removable protector for protecting a thermally responsive member of a sprinkler head of claim 32, said releasable fastener further comprising:

a male hook mounted on said first shield proximate said first end of said first shield;

a female slot extending through said second shield proximate said first end of said second shield;

said male hook being positioned to engage and lock within said female slot to secure said protector in place when said major protective surfaces of said first and second shields are proximate the exposed portions of the surface area of the thermally responsive member of the sprinkler head.

35. The removable protector for protecting a thermally responsive member of a sprinkler head of claim 32, said releasable fastener further comprising:

a male stanchion mounted on a first tab, said first tab mounted on said first shield proximate said first end of said first shield;

a female slot mounted on a second tab, said second tab mounted on said second shield proximate said first end of said second shield;

said male stanchion being positioned to engage and lock within said female slot to secure said protector in place when said major protective surfaces of said first and second shields are proximate the exposed portions of the surface area of the thermally responsive member of the sprinkler head.

36. The removable protector for protecting a thermally responsive member of a sprinkler head of claim 32, said releasable fastener further comprising:

a male stanchion mounted on a first offset tab, said first offset tab mounted on said first shield proximate said first end of said first shield;

a female slot mounted on a second offset tab, said second offset tab mounted on said second shield proximate said first end of said second shield;

said male stanchion being positioned to engage and lock within said female slot to secure said protector in place when said first and second offset tabs are slightly twisted and when said major protective surfaces of said first and second shields are proximate the exposed portions of the surface area of the thermally responsive member of the sprinkler head.

37. The removable protector for protecting a thermally responsive member of a sprinkler head of claim 32, said cross member being connected to said second end of said first shield with a first living hinge, said first living hinge allowing said first shield to be rotated about said first living hinge to variable angles with respect to said cross member, said cross member being connected to said second end of said second shield with a second living hinge, said second living hinge allowing said second shield to be rotated about said second living hinge to variable angles with respect to said cross member.

38. The removable protector for protecting a thermally responsive member of a sprinkler head of claim 32, the sprinkler head having a base with depending arms extending therefrom, the depending arms separated from each other by a depending arm space, the depending arms positioning a deflector at a position that is distal the base of the sprinkler head and separated therefrom by a deflector space, the deflector having a deflector width, the depending arms extending along either side of the thermally responsive member, and the base of the sprinkler head having a base width, said protector further comprising:

said first and second shields each having preselected lengths that permit each of said first and second shields to extend fully along the depending arm space between the depending arms when said protector is attached to the sprinkler head;

said first and second shields each having preselected heights that permit said major protective surfaces of said first and second shields to extend along the exposed portion of the surface area of the thermally responsive member, said preselected heights of said first and second shields permitting said first and second shields to fit within the deflector space, said preselected lengths and heights of said first and second shields thereby permitting said major protective surfaces of said first and second shields to provide continuous protection of said thermally responsive member while said protector is attached to the sprinkler head;

said cross member of said protector having a width that is less than the base width of the sprinkler head and that is less than the deflector width so that said major protective surfaces of said first and second shields are spaced apart from each other by an attachment clearance when said protector is attached to the sprinkler head, said attachment clearance being less than said base width of the sprinkler head and less than said deflector width wherein said major protective surfaces are locked in positions to protect the thermally responsive member when said protector is attached to the sprinkler head.

39. The removable protector for protecting a thermally responsive member of a sprinkler head of claim 32, the sprinkler head having a base, the base having a base width and a plurality of gripping surfaces for engaging an installation tool, said first and second shields of said protector being separated by an attachment clearance when said protector is attached to the sprinkler head, said attachment clearance being less than the base width wherein an installation tool can engage the gripping surfaces of the sprinkler head without requiring removal of said protector from the sprinkler head.

40. The removable protector for protecting a thermally responsive member of a sprinkler head of claim 32, the sprinkler head having a base with depending arms extending therefrom, the depending arms separated from each other by a depending arm space, the depending arms positioning a deflector at a position that is distal the base of the sprinkler head and separated therefrom by a deflector space, the deflector having a deflector width, the depending arms extending along either side of the thermally responsive member, the base of the sprinkler head having a base width and a plurality of tool gripping surfaces for engaging the inside surface of an installation tool, said protector further comprising:

said first and second shields each having lengths that permit each of said first and second shields to extend fully along the depending arm space between the depending arms when said protector is attached to the sprinkler head, said first and second shields each having heights that are large enough to permit said major protective surfaces of said first and second shields to extend along the exposed portion of the surface area of the thermally responsive member, and k short enough to allow said first and second shields to fit within the deflector space, said lengths and heights of said first and second shields thereby permitting said major protective surfaces of said first and second shields to provide continuous protection of the thermally responsive member while said protector is attached to the sprinkler head;

said cross member of said protector having a width that is less than the base width of the sprinkler head and that is less than the deflector width so that said major protective surfaces of said first and second shields are spaced apart from each other by an attachment clearance when said protector is attached to the sprinkler head; and said attachment clearance being less than said base width of the sprinkler head and less than said deflector width so that said major protective surfaces are locked in positions to protect the thermally responsive member when said protector is attached to the sprinkler head and to allow an installation tool to engage the gripping surfaces of the sprinkler head without requiring removal of said protector from the sprinkler head.

41. The removable protector for protecting a thermally responsive member of a sprinkler head of claim 32, the sprinkler head having a base, the base having a base width and a plurality of gripping surfaces for engaging an installation tool, said first and second shields of said protector being separated by an attachment clearance when said protector is attached to the sprinkler head, said attachment clearance being less than the base width to allow an installation tool to engage the gripping surfaces of the sprinkler head during installation of the sprinkler head on a mounting plate without requiring removal of said protector from the sprinkler head.

42. The removable protector for protecting a thermally responsive member of a sprinkler head of claim 32, the sprinkler head being mounted on a mounting plate, the mounting plate having an outside diameter for engaging an escutcheon plate, the escutcheon plate having an inside diameter for engaging the mounting plate, said protector having a length that permits the outside diameter of the mounting plate to engage the inside diameter of the escutcheon plate while said protector remains attached to the sprinkler head and while the sprinkler head remains mounted on the mounting plate.

43. The removable protector for protecting a thermally responsive member of a sprinkler head of claim 32, said first and second shields each having preselected lengths that permit the sprinkler head to be stored in a multiple unit carton while said protector is attached to the sprinkler head.

44. The removable protector for protecting a thermally responsive member of a sprinkler head of claim 32, the sprinkler head having a base with depending arms extending therefrom and defining a bisecting plane having first and second bisecting plane sides, the depending arms separated from each other by a depending arm space, the depending arms positioning a side deflector at a position that is distal the base of the sprinkler head and separated therefrom by a first deflector space in the first bisecting plane side and by a second deflector space in the second bisecting plane side, the side deflector having a deflector width, the depending arms extending along either side of the thermally responsive member, and the base of the sprinkler head having a base width, said protector further comprising:

said first and second shields each having a preselected length which permits each of said first and second shields to extend fully along the depending arm space between the depending arms when said protector is attached to the sprinkler head;

said first shield having a preselected height which permits said major protective surface of said first shield to extend along the exposed portion of the surface area of the thermally responsive member in the first bisecting plane side, said second shield having a preselected height which permits said major protective surface of said second shield to extend along the exposed portion of the surface area of the thermally responsive member in the second bisecting plane side, said preselected height of said first shield permits said first shield to fit within the first deflector space in the first bisecting plane side, said preselected height of said second shield permits said second shield to fit within the second deflector space in the second bisecting plane side;

said cross member of said protector having a width that is less than the base width of the sprinkler head and that is less than the deflector width so that said major protective surfaces of said first and second shields are spaced apart from each other by an attachment clearance when said protector is attached to the sprinkler head, said attachment clearance being less than the base width of the sprinkler head and less than the deflector width wherein said major protective surfaces are locked in positions to protect the thermally responsive member when said protector is attached to the sprinkler head.

45. The removable protector for protecting a thermally responsive member of a sprinkler head of claim 32, the sprinkler head having a base with depending arms extending therefrom, the depending arms separated from each other by a depending arm space, the depending arms positioning a deflector at a position that is distal the base of the sprinkler head and separated therefrom by a deflector space, the deflector including a side deflector panel separated from the base of the sprinkler by a side deflector panel space, the deflector having a deflector width, the depending arms extending along either side of the thermally responsive member, and the base of the sprinkler head having a base width, said protector further comprising:

said first and second shields each having lengths that permit each of said first and second shields to extend fully along the depending arm space between the depending arms when said protector is attached to the sprinkler head, said first and second shields each having preselected heights that permit said major protective surfaces to extend along the exposed portion of the surface area of the thermally responsive member and permit said first and second shields to fit within the deflector space, said lengths and heights of said first and second shields thereby permitting said major protective surfaces of said first and second shields to provide continuous protection of the thermally responsive member while said protector is attached to the sprinkler head;

said cross member of said protector having a width that is significantly less than the base width of the sprinkler head and that is less than the deflector width so that said major protective surfaces of said first and second shields are spaced apart from each other by an attachment clearance when said protector is attached to the sprinkler head, said attachment clearance being less than the base width of the sprinkler head and less than the deflector width wherein said major protective surfaces are locked in positions to protect the thermally responsive member when said protector is attached to the sprinkler head;

said protector having a side deflector panel accommodation notch, said side deflector panel accommodation notch being positioned to allow clearance for the side deflector panel wherein said protector fits within the side deflector panel space between the side deflector panel and the base of the sprinkler head when said protector is attached to the sprinkler head.

46. The removable protector for protecting a thermally responsive member of a sprinkler head of claim 32, the sprinkler head having a base with depending arms extending therefrom, said releasable fastener comprising a first boss mounted to said first shield and a second boss mounted to said second shield, said first boss and said second boss being positioned to engage the sprinkler head between the thermally responsive member and at least one of the depending arms of the sprinkler head when said protector is attached to the sprinkler head.

47. The removable protector for protecting a thermally responsive member of a sprinkler head of claim 32, the sprinkler head having a base with depending arms extending therefrom, said releasable fastener comprising a first pair of positioning lugs mounted to said first shield and a second pair of positioning lugs mounted to said second shield, each of said first pair of positioning lugs and said second pair of positioning lugs being positioned to cause said fastener to engage the sprinkler head at at least one of the depending arms of the sprinkler head when said protector is attached to the sprinkler head.

48. The removable protector for protecting a thermally responsive member of a sprinkler head of claim 32, the sprinkler having a deflector mounted thereon, the deflector having a width, said protector further comprising:

said cross member having a width of a preselected size that said major protective surfaces of said first and second shields are spaced apart from each other by an attachment clearance that is less than the width of the deflector;

said major protective surface of said first shield having a first slot and said major protective surface of said second shield having a second slot, said first and second slots being positioned to accept a portion of the width of the deflector that exceeds said attachment clearance between said first and second shields.

49. The removable protector for protecting a thermally responsive member of a sprinkler head of claim 32, said protector further comprising an enclosure comprising:

a first enclosure surface extending from said second end of each of said first and second shields, said first enclosure surface of said first shield extending inward toward said second shield when said protector is attached to said sprinkler head, said first enclosure surface of said second shield extending inward toward said first shield when said protector is attached to said sprinkler head;

a second enclosure surface extending between said second end and said first end of each of said first and second shields, said second enclosure surface of said first shield extending inward toward said second shield when said protector is attached to said sprinkler head, said second enclosure surface of said second shield extending inward toward said first shield when said protector is attached to said sprinkler head;

a third enclosure surface extending from said first end of each of said first and second shields, said third enclosure surface of said first shield extending inward toward said second shield when said protector is attached to said sprinkler head, said third enclosure surface of said second shield extending inward toward said first shield when said protector is attached to said sprinkler head.

50. The removable protector for protecting a thermally responsive member of a sprinkler head of claim 32, the sprinkler having a deflector mounted thereon, the deflector having a width, said protector further comprising:

said cross member having a width of a preselected size that said major protective surfaces of said first and second shields are spaced apart from each other by an attachment clearance that is less than the width of the deflector;

said major protective surface of said first shield having a first slot and said major protective surface of said second shield having a second slot, said first and second slots being positioned to accept a portion of the width of the deflector that exceeds said attachment clearance between said first and second shields;

an enclosure, said enclosure having a first enclosure surface extending from said second end of each of said first and second shields, said first enclosure surface of said first shield extending inward toward said second shield when said protector is attached to said sprinkler head, said first enclosure surface of said second shield extending inward toward said first shield when said protector is attached to said sprinkler head;

said enclosure having a second enclosure surface extending between said second end and said first end of each of said first and second shields, said second enclosure surface of said first shield extending inward toward said second shield when said protector is attached to said sprinkler head, said second enclosure surface of said second shield extending inward toward said first shield when said protector is attached to said sprinkler head; and said enclosure having a third enclosure surface extending from said first end of each of said first and second shields, said third enclosure surface of said first shield extending inward toward said second shield when said protector is attached to said sprinkler head, said third enclosure surface of said second shield extending inward toward said first shield when said protector is attached to said sprinkler head.

51. The removable protector for protecting a thermally responsive member of a sprinkler head of claim 32, said cross member having a width defining an attachment clearance between said first and second shields, the thermally responsive member of the sprinkler head having a dimension that extends beyond said attachment clearance, said first J shield having an expanded radius to accommodate the dimension of the sprinkler that extends beyond said attachment clearance.

52. The removable protector for protecting a thermally responsive member of a sprinkler head of claim 32, said cross member having a width defining an attachment clearance between said first and second shields, the thermally responsive member of the sprinkler head having a dimension that extends beyond said attachment clearance, each of said first and second shields having an expanded radius to accommodate the dimension of the sprinkler that extends beyond said attachment clearance.

53. The removable protector for protecting a thermally responsive member of a sprinkler head of claim 32, said releasable fastener further comprising:

a male stanchion mounted on said major protective surface of said first shield proximate said first end of said first shield;

a female stanchion mounted on said major protective surface of said second shield proximate said first end of said second shield;

said male stanchion being positioned to engage said female stanchion under compression to secure said protector in place when said major protective surfaces of said first and second shields are proximate the exposed portions of the surface area of the thermally responsive member of the sprinkler head.

54. The removable protector for protecting a thermally responsive member of a sprinkler head of claim 32, said releasable fastener further comprising:

a first slot extending through said major protective surface of said first shield proximate said first end of said first shield;

a second slot extending through said major protective surface of said second shield proximate said first end of said second shield;

a connection pin extending through said first slot in said first shield, said connection pin positioned to be inserted into and to engage said second slot in said second shield to secure said protector in place when said major protective surfaces of said first and second shields are proximate the exposed portions of the surface area of the thermally responsive member of the sprinkler head.

55. The removable protector for protecting a thermally responsive member of a sprinkler head of claim 54, said connection pin is a friction pin.

56. The removable protector for protecting a thermally responsive member of a sprinkler head of claim 54, said connection pin is a tension pin.

57. The removable protector for protecting a thermally responsive member of a sprinkler head of claim 32, the sprinkler head having a sprinkler head color, said protector has a protector color that contrasts the sprinkler head color to increase visibility of said protector from a distance when said protector is attached to the sprinkler head.

58. The removable protector for protecting a thermally responsive member of a sprinkler head of claim 32, the sprinkler head having a sprinkler head color, said protector has a fluorescent color that contrasts the sprinkler head color to increase visibility of said protector from a distance when said protector is attached to the sprinkler head.

59. The removable protector for protecting a thermally responsive member of a sprinkler head of claim 32, the sprinkler head having a base with depending arms extending therefrom, said protector being formed from a single flexible component having said second ends of said first and second shields flexibly molded to said cross member, said releasable fastener comprising a first boss mounted to said first shield and a second boss mounted to said second shield, said protector having a memory shape to cause said fastener to engage the sprinkler head between the thermally responsive member and at least one of the depending arms of the sprinkler head when said protector is attached to the sprinkler head.

60. The removable protector for protecting a thermally responsive member of a sprinkler head of claim 32, the sprinkler head having a base with depending arms extending therefrom, said protector being formed from a single flexible component having said second ends of said first and second shields flexibly molded to said cross member, said releasable fastener comprising a first pair of positioning lugs mounted to said first shield and a second pair of positioning lugs mounted to said second shield, said protector having a memory shape to cause said fastener to engage the sprinkler head at at least one of the depending arms of the sprinkler head when said protector is attached to the sprinkler head.

61. The removable protector for protecting a thermally responsive member of a sprinkler head of claim 32, said releasable fastener further comprising:

a first protective tab extending inward from said first end of said first shield toward said first end of said second shield;

a second protective tab extending inward from said first end of said second shield toward said first end of said first shield.

62. A removable protector for protecting a thermally responsive member of a sprinkler head from damage while said protector is attached to the sprinkler head, the sprinkler head having a base with depending arms extending therefrom, the depending arms separated from each other by a depending arm space, the depending arms positioning a deflector at a position that is distal the base of the sprinkler head and separated therefrom by a deflector space, the deflector having a deflector width, the depending arms extending along either side of the thermally responsive member, the base of the sprinkler head having a base width and a plurality of tool gripping surfaces for engaging the inside surface of an installation tool, the thermally responsive member having a surface area which includes an exposed portion that is capable of making contact with objects that are external to the sprinkler head, said protector further comprising:

a first shield and a second shield, each of said first and second shields having a first end and a second end, each of said first and second shields having a major protective surface which extends along the exposed portion of the surface area of the thermally responsive member when said protector is attached to the sprinkler head;

a cross member connected to each said second end of each of said first and second shields, said cross member being connected to said second end of said first shield with a first living hinge, said first living hinge allowing said first shield to be rotated about said first living hinge to variable angles with respect to said cross member, said cross member being connected to said second end of said second shield with a second living hinge, said second living hinge allowing said second shield to be rotated about said second living hinge to variable angles with respect to said cross member;

a releasable fastener including a male stanchion mounted on said major protective surface of said first shield proximate said first end of said first shield and a female stanchion mounted on said major protective surface of said second shield proximate said first end of said second shield, said male stanchion being positioned to engage and lock within said female stanchion when said major protective surfaces of said first and second shields are proximate the exposed portions of the surface area of the thermally responsive member of the sprinkler head to provide continuous protection of the thermally responsive member from objects that are external to the sprinkler head while said protector is attached to the sprinkler head;

said first and second shields each having preselected lengths that permit each of said first and second shields to extend along the depending arm space between the depending arms when said protector is attached to the sprinkler head, said first and second shields each having preselected heights that permit said major protective surfaces to extend along the exposed portion of the surface area of the thermally responsive member, said first and second shields also having preselected heights that permit said first and second shields to fit within the deflector space, said lengths and heights of said first and second shields thereby permitting said first and second shields to provide continuous protection of the thermally responsive member while said protector is attached to the sprinkler head;

said cross member of said protector having a width that is less than the base width of the sprinkler head and that is less than the deflector width so that said major protective surfaces of said first and second shields are spaced apart from each other by an attachment clearance when said protector is attached to the sprinkler head, said attachment clearance being less than said base width of the sprinkler head and being less than said deflector width wherein said major protective surfaces are locked in positions to protect the thermally responsive member when said protector is attached to the sprinkler head;

said attachment clearance also being less than said base width to permit an installation tool to engage said tool gripping surfaces for installing the sprinkler head while said protector is attached to the sprinkler head.

* * * * *

UNITED STATES PATENT AND TRADEMARK OFFICE

CERTIFICATE OF CORRECTION

PATENT NO. : 6,669,111 B2 
DATED : December 30, 2003
INVENTOR(S) : Chris A. Vinson and Thomas E. Dorich It is certified that error appears in the above-identified patent and that said Letters Patent is hereby corrected as shown below:

Column 26,
Line 33, delete “k” before the words “short enough.”

Column 30,
Line 14, delete “J” at end of line after word “first.”

Signed and Sealed this

Seventh Day of September, 2004

JON W. DUDAS
*Director of the United States Patent and Trademark Office*